US011333151B2

(12) United States Patent
Blad

(10) Patent No.: US 11,333,151 B2
(45) Date of Patent: May 17, 2022

(54) PUMP ASSEMBLY

(71) Applicant: GRUNDFOS HOLDING A/S, Bjerringbro (DK)

(72) Inventor: Thomas Blad, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 261 days.

(21) Appl. No.: 16/492,795

(22) PCT Filed: Mar. 13, 2018

(86) PCT No.: PCT/EP2018/056207

§ 371 (c)(1),
(2) Date: Sep. 10, 2019

(87) PCT Pub. No.: WO2018/167043

PCT Pub. Date: Sep. 20, 2018

(65) Prior Publication Data

US 2020/0056614 A1 Feb. 20, 2020

(30) Foreign Application Priority Data

Mar. 14, 2017 (EP) ..... 17160830.0

(51) Int. Cl.
*F04D 15/00* (2006.01)
*F24D 3/10* (2006.01)
(Continued)

(52) U.S. Cl.
CPC ..... *F04D 1/006* (2013.01); *F04D 13/06* (2013.01); *F04D 15/0016* (2013.01);
(Continued)

(58) Field of Classification Search
CPC ..... F04D 29/4293; F04D 15/0005; F04D 29/167; F04D 29/486; F04D 29/708; F04D 15/0022; F04D 15/0066
See application file for complete search history.

(56) References Cited

U.S. PATENT DOCUMENTS 5,924,432 A * 7/1999 Thies ..... A47L 15/23 134/56 D
6,257,177 B1 * 7/2001 Lehmann ..... F01P 5/10 123/41.41

(Continued)

FOREIGN PATENT DOCUMENTS

DE 9013992 U1 10/1991
FR 1382168 * 9/1963
WO 2016/102269 A1 6/2016

*Primary Examiner* — Courtney D Heinle
*Assistant Examiner* — Andrew J Marien
(74) *Attorney, Agent, or Firm* — McGlew and Tuttle, P.C.

(57) ABSTRACT

A centrifugal pump assembly includes an electrical drive motor (4, 6), an impeller (14) which is driven by the drive motor and a pump casing (12) surrounds the impeller and including two branches (27, 32, 34). A movable valve element (18) is arranged in the pump casing and is movable between two switching positions, in which the flow paths through the two branches (27, 32, 34) are opened to a different extent. The valve element (18) is configured and arranged in the pump casing (12) such that it separates a suction chamber (24) which is connected to a suction side of the impeller (14) from a delivery chamber (26) which is in connection with the delivery side of the impeller (14). The valve element (18) is mechanically and/or hydraulically coupled to the drive motor (4, 6) for at least a movement between the two switching positions.

20 Claims, 32 Drawing Sheets

(51) Int. Cl.

| | |
|---|---|
| ***F04D 1/00*** | (2006.01) |
| ***F04D 13/06*** | (2006.01) |
| *F04D 29/42* | (2006.01) |
| *F04D 29/48* | (2006.01) |

(52) U.S. Cl.
CPC ..... *F04D 29/4273* (2013.01); *F04D 29/4293* (2013.01); *F04D 29/486* (2013.01); *F24D 3/105* (2013.01)

(56) References Cited

U.S. PATENT DOCUMENTS

| | | | | |
|---|---|---|---|---|
| 2016/0258340 | A1* | 9/2016 | Klippert | F04D 29/22 |
| 2016/0273543 | A1* | 9/2016 | Blad | F04D 29/0416 |

* cited by examiner

PUMP ASSEMBLY

CROSS REFERENCE TO RELATED APPLICATIONS

This application is a United States National Phase Application of International Application PCT/EP2018/056207, filed Mar. 13, 2018, and claims the benefit of priority under 35 U.S.C. § 119 of European Application 17 160 830.0, filed Mar. 14, 2017, the entire contents of which are incorporated herein by reference.

TECHNICAL FIELD

The invention relates to a centrifugal pump assembly with an electric drive motor and with a valve element which is arranged in the pump assembly and which is movable between at least two switching positions.

TECHNICAL BACKGROUND

Centrifugal pump assemblies which simultaneously contain a valve device which permits the switching between two flow paths, through which the centrifugal pump assembly delivers, are known. Here, such valve devices which switch in a manner depending on the rotation direction of the centrifugal pump assembly are known. Such a centrifugal pump assembly which comprises a switch-over device, with the help of which one can switch between two inlets of the centrifugal pump assembly is known for example from DE 9013992 U1. The centrifugal pump assembly which is disclosed there comprises a relatively complicated mechanism which comprises an onflow element which is situated at the delivery side and which is subjected to onflow by the outlet-side flow produced by the centrifugal pump assembly and which can be moved into two different positions depending on the flow direction. A valve element at the suction side of the pump assembly is switched between the two inlets via a lever system which is connected to the onflow element.

SUMMARY

With regard to this state of the art, it is the object of the invention to improve a centrifugal pump assembly with an integrated valve element, to the extent that a simpler construction of the centrifugal pump assembly is achieved with a simultaneously increased reliability of the switching function of the valve element.

The centrifugal pump assembly according to the invention comprises an electrical drive motor as well as at least one impeller which is rotatingly driven by this electrical drive motor. For this, a rotor of the electrical drive motor is connected to the impeller, for example via a shaft. The impeller is arranged in a pump casing which surrounds the impeller and which preferably outwards delimits the space filled with fluid to be delivered. The pump casing comprises at least two branches (branch connections or simply connections), in particular two suction-side inlets and a delivery-side outlet. This means that the impeller sucks a fluid preferably from at least one of the two inlets and delivers it to the delivery-side outlet. A movable valve element which is movable between at least two switching positions, in which the flow paths through the two branches, in particular the two inlets are open to a different extent, is arranged in the pump casing. This means that the two branches or inlets are opened to a differently wide extent and thus the flow cross sections of the branches or inlets change, by way of changing the switching position of the valve element. In the simplest case, one can provide a pure switch-over, wherein in one of the two switching positions a first branch or inlet is opened and a second branch or inlet is closed, whereas in the second switching position the first branch or inlet is closed and the second branch or inlet is opened. However, it is also conceivable for one or more switching positions to be provided, in which switching positions not one of the branches or inlets is completely closed, but merely the opening degree of the two branches or inlets to one another is changed, so that in a first switching position for example the first branch or inlet is opened to a greater extent than in a second switching position. A mixing ratio of the flows through the first and the second inlet between the two switching positions could therefore be changed by way of moving the valve element, i.e. the valve element could act as an adjustable mixing valve.

According to the invention, the design of the valve element and its arrangement in the pump casing is such that it is situated in the pump casing between the suction side and the delivery side of the centrifugal pump assembly and separates these from one another. The valve element is preferably arranged such that its separates a suction chamber which is connected to a suction side of the impeller and into which the two inlets preferably run out, from a delivery chamber which is in connection with the delivery side of the impeller and preferably with a branch as the outlet. This means that the valve element is adjacent to the suction chamber as well as to the delivery chamber. The valve element therefore preferably comprises a side which faces the suction chamber and which comes into contact with the fluid in the suction chamber, and a side which faces the delivery chamber, comes into contact with the pressure in the delivery chamber and is subjected to the pressure in the delivery chamber. Due to the fact that the valve element is adjacent to the delivery side as well as to the suction side, on the one hand it is possible to utilize pressure differences between both sides for moving the valve element. On the other hand, further forces which act in the delivery chamber and/or in the suction chamber, in particular flow forces of the flowing fluid can be utilized to actuate the valve element. In particular, it is possible to use the forces prevailing in the delivery chamber and thereby to carry out a switching function at the suction side.

According to the invention, the valve element is mechanically and/or hydraulically coupled to the drive motor for at least a movement between the at least two switching positions. This coupling is assisted by the arrangement of the valve element between the delivery chamber and the suction chamber. At the one side, the valve element can interact with the two inlets in the suction chamber, in order to change the flow paths through these two inlets in the at least two switching positions. On the other side, the valve element directly faces the delivery chamber which is to say has a side which delimits the delivery chamber and on which the mechanical and/or hydraulic coupling can engage for moving the valve element. Complicated mechanisms for coupling an onflow element which is situated in the pressure chamber, to a valve element which is situated in the suction chamber, can be avoided in this manner. In contrast, it is possible to subject the valve element to force directly in the delivery chamber, in order to move it between the switching positions. The valve element thus preferably comprises force engagement elements or force engagement surfaces which face the delivery chamber and upon which the mechanical and/or hydraulic coupling engages.

The hydraulic coupling between the drive motor and valve element can be effected particularly preferably via the fluid located in the delivery chamber. The fluid is brought into motion for example by the impeller itself and transmits this movement onto the valve element. This can be effected for example by way of friction forces which prevail between the valve element and the fluid. In particular, a friction of the fluid which flows in the delivery chamber, said friction being at the walls which delimit the delivery chamber and prevailing in the delivery chamber, can be utilized in order to move the valve element. The valve element can thus be moved at its side which faces the delivery chamber, via the friction of a fluid flow which occurs there. The movement of the valve element can therefore be accomplished by way of the energy which is otherwise lost due to friction.

Particularly preferably, the valve element is rotatable between the at least two switching positions. This permits a particularly simple movement coupling since a rotation movement is produced by the drive motor in any case. Thus for example a flow which rotates in the delivery chamber can act upon the valve element and move this in a rotating manner.

The rotation axis, about which the valve element is rotatable usefully extends parallel to the rotation axis of the impeller and further preferably in a manner aligned to the rotation axis of the impeller, i.e. preferably essentially in the extension of the rotation axis of the impeller. One therefore succeeds in the impeller or the rotor of the drive motor as well as the valve element rotating about the same axis. A very simple hydraulic and/or mechanical coupling between the valve element and the drive motor or impeller is therefore possible. Preferably, no gear elements whatsoever are necessary, i.e. one can make do without gearwheels, levers or the like.

Further preferably, the valve element is rotatably mounted in its center and in particular is rotatably mounted in the pump casing independently of the impeller. Here, the valve element is further preferably configured such that in at least one position it is in contact with the pump casing merely via the central mounting and possibly necessary restoring elements (e.g. restoring springs) and otherwise can freely rotate about this central mounting. The central mounting is preferably configured such that the radius (outer radius) of the bearing (mounting) surfaces is preferably less than a third, further preferably less than a quarter of the radius of the outer periphery of the valve element. A very easy rotatability of the valve element by forces which engage outside the mounting is achieved by way of this, since these forces act upon the mounting via a comparatively long lever. A particularly easy-motion mounting of the valve element permits this element to be able to be moved between the at least two switching positions by way of comparatively small forces. This for example favors a hydraulic coupling between the drive motor and the valve element.

Further preferably, the valve element is rotatably mounted in the inside of the pump casing in a space which is filled with a fluid to be delivered or with a liquid to be delivered. This means that the mounting is configured in a "wet" manner, so that the mounting can be lubricated by the fluid itself. Moreover, no sealed shaft feed-throughs through the pump casing to the outside are necessary. Despite this, the mounting in the inside of the pump casing can further preferably be sealed off with respect to the surrounding fluid by way of seals. However, such a sealing can be configured such that it is not hermetically tight, but lets through a certain small quantity of fluid which can then serve for example for the lubrication of the bearing. Here, contaminations can however be held back by the seal and one can therefore prevent contamination from entering into the mounting. For this, a sealing gap in the seal is preferably dimensioned such that the fluid to be delivered, e.g. water can pass through the sealing gap, but contamination such as particles are however held back. The mounting can moreover be preferably pre-lubricated, in particular also permanently lubricated. This means that a lubricant can firstly be brought into the mounting, said lubricant in the course of the operating time possibly being diluted and/or replaced by the fluid in the inside of the pump casing.

According to a further particular embodiment of the invention, the valve element is configured and arranged in a manner such that it is movable between the at least two switching positions along a first movement path and is additionally movable in a second movement path which runs in an angled manner to the first movement path. Here, the first movement path is preferably a rotation movement about a rotation axis as has been described above. The second movement path is preferably a movement path which runs in a linear manner, in particular along the rotation axis or parallel to the rotation axis of the valve element. Along the second movement path, the valve element is preferably movable between a first position, in which it is distanced to at least one contact surface (bearing surface), and a second position, in which it is in bearing contact with this contact surface. In the first position, the valve element is preferably freely rotatable about a mounting in the previously described manner. In the second position, it preferably comes to bear on the contact surface which in particular can be formed on the pump casing. The further rotation movement can be prevented and/or a sealing realized by way of this bearing contact.

According to a further preferred embodiment, at least one damping means can be provided, said damping means being connected to the valve element or interacting with it and being configured in a manner such that a movement of the valve element along the second movement path is damped or delayed. Here, the damping can act given a movement from the first position into the second position and/or given a movement from the second position into the first position. An action or effect is preferably given at least with the movement from the second position into the first position. One succeeds in a disengagement from the at least one contact surface being delayed and the valve element therefore being held for longer in a fixed, non-rotatable position by way of this. By way of this, if the valve element has been moved by the drive motor into a desired switching position, one can succeed in the valve element remaining in the previously assumed position after switching off and reassuming operation of the drive motor in the reverse direction, inasmuch as the drive motor is put into operation again in a sufficiently rapid manner. A rapid pressure build up in the delivery chamber can be achieved by way of the rapid starting operation, and this pressure build-up holds the valve element in bearing contact against the contact surface. On account of the damping, it is ensured here that a pressure can build up before the valve element gets into its freely rotatable condition.

The second movement path of the valve element preferably runs parallel to or along the rotation axis of the impeller which, as described above, is further preferably aligned with the rotation axis of the valve element.

According to another possible form of the invention, an end position of the movement of the valve element along the second path of movement, which preferably runs parallel to the axis of rotation of the impeller, is defined by a stop at the axial end of a rotor shaft of the drive motor. I.e., in an end position of the movement of the valve element along the second movement path, the valve element preferably comes into contact with the axial front end of the rotor shaft, so that the movement in this direction is limited by the stop on the rotor shaft.

According to a further preferred embodiment, the valve element can be subjected to a restoring force from a restoring element, for example a restoring spring, said force acting along the second movement path and preferably in the direction of the first position. The restoring elements seeks to move the valve element back into an initial position, wherein the initial position is preferably the first position, in which further preferably the valve element is freely rotatable. One can therefore succeed in the valve element moving back into the first position by way of the restoring element after the fading of the forces and moments which are produced by the impeller when the drive motor is switched off.

Further preferably, the valve element comprises a pressing (pressure) surface which faces the delivery chamber and upon which the pressure prevailing in the delivery chamber acts in a manner such that the valve element is subjected to a pressing force along the second movement path, said pressing force preferably acting in the direction of the second position. The pressing force therefore preferably acts counter to the restoring force. By way of this design, given a pressure build-up in the delivery chamber, caused by way of rotation of the impeller, one succeeds in this pressure, when it reaches a sufficient magnitude, moving the valve element into its second position, in which it preferably comes into bearing contact with a contact surface. A pressure force which is caused by the centrifugal pump assembly itself can therefore be used to move the valve element into a certain position. If the drive motor is stopped and the pressure prevailing in the delivery chamber drops again, the valve element is then preferably moved back again into its first position by a restoring element.

Preferably, the described at least one contact surface is at least one sealing surface. In particular, this can be a sealing surface which is situated such that delivery (pressure) region is sealed with respect to the suction region by way of the valve element bearing on the sealing surface. Alternatively or additionally, at least one sealing surface can be provided and situated in a manner such that one of the branches and in particular one of the inlets is sealed with respect to the suction chamber by way of the valve element bearing on this sealing surface. This inlet is then preferably sealingly closed with respect to the suction chamber, so that the centrifugal pump assembly sucks fluid through the other inlet. Since the valve element is only in sealing contact with the sealing surface or surfaces in the second position in the case of this design, one succeeds in the sealing surfaces being able to disengage in the first position and the friction forces prevailing on the valve element being reduced in the first position, so that in the first position this element can be easily moved between its at least two switching positions.

The at least one contact surface preferably extends in an angled manner to the second movement path, i.e. a force which prevails in the direction of the movement path can lead to a pressing force upon the contact surface. The valve element can therefore be pressed against the contact surface and in particular a sealing surface for sealing, by such a pressing force, in particular by a pressing force which acts along the second movement path and which is caused by the pressure prevailing in the delivery chamber.

As described above, the valve element is mechanically and/or hydraulically coupled to the drive motor for its movement. The valve element can thus be moved between the at least two switching positions by way of the drive motor, wherein further preferably the valve element is moved into one of the two switching positions in a manner dependent on the rotation direction of the drive motor. For this, a stop which prevents a further movement of the valve element in the same direction can be provided in each of the switching positions.

According to a first embodiment, the drive motor can merely be put into operation in the desired rotation direction depending on the desired switching position of the valve element, wherein different efficiencies for the two rotation directions can be achieved depending on the design of the impeller.

According to a particular embodiment of the invention, it is however also possible to utilize a rotation direction change of the drive motor merely for moving the valve element between the switching positions and to always use a preferred rotation direction for delivery independently of the switching position.

Given a suitable activation of the drive motor and of the delay of the movement of the valve element in the second movement direction, said delay having been described above, one can succeed e.g. in the valve element being firstly moved by the drive motor into a first switching position by way of the drive motor being rotated in the direction of this switching position. Here, the valve element is preferably moved into its second position by way of the pressure which builds up in the delivery chamber. If the drive motor is then subsequently switched off and very rapidly rotated into the opposite movement direction, one can succeed in a pressure being built up again in such a rapid manner in the delivery chamber by way of rotation of the impeller in the other movement direction, that the valve element is not able to be moved completely at all into the freely rotatable first position due to the described damping or delay, and therefore remaining in the previously assumed switching position, even if the impeller is subsequently rotated by the drive motor in the direction of the second switching position in the opposite rotation direction.

According to a further preferred embodiment of the invention, a force generating means which exerts a force in the direction of one of the at least two switching positions upon the at least one valve element is present, wherein the force is preferably a spring force, a magnetic force and/or the gravitational force. One can make do without a rotation direction change of the drive motor by way of such a force generating means. The valve element can thus be moved into one of the two switching positions by way of the drive motor and then, on switching off the drive motor, can be moved back again into the other switching position by the force generating means, said other switching position representing an initial position. The drive motor can therefore be configured such that in this initial position, it can be put into operation in such a rapid manner that a pressure builds up in the delivery chamber, said pressure pressing the valve element along the second movement path against the contact surface before the valve element can be moved into its second switching position by a flow building up in the delivery chamber. If the drive motor is brought into operation in an accordingly slow manner, then the flow which moves the valve element into the second switching position can firstly build up before the pressure is adequately large to press the valve element along the second movement path against the contact surface. This can be achieved by way of a suitable activation (control) of the drive motor via a control device which activates the drive motor.

For the coupling between the valve element and the drive motor, the valve element is preferably configured such that it is movable by way of a fluid flow which runs in the delivery chamber in the rotation direction of the impeller and/or that the valve element for its movement is coupled to the impeller or to a shaft which drives the impeller, via a coupling which is preferably releasable in a pressure-dependent and/or speed-dependent and/or rotation-direction-dependent manner. The propulsion via the fluid flow which rotates in the delivery chamber can preferably be effected in a manner such that this fluid flow engages on a surface of the valve element which faces the delivery chamber by way of friction forces. This surface of the valve element can be additionally provided with catches, in particular with blades. Such blades can further preferably simultaneously serve as guide vanes in order to deflect the flow which exits radially out of the impeller, into a desired direction. As long as the impeller is freely rotatable, such a flow can also engage at the suction side and cause a rotation of the valve element. For this, in particular the inlets at the suction side or in the suction chamber can be placed such that they direct the flow in the suction chamber such that they assist in a rotation or movement of the valve element into a desired direction. For this, the valve element according to a particular embodiment can also be provided with corresponding catch elements or blades on the surface which faces the suction side, upon which catch elements or blades a flow in the suction chamber can act for the movement of the valve element. The surface of the valve element which faces the delivery chamber is preferably configured in such large manner that an outer diameter of this surface of the valve element is at least twice to five times as large as the diameter of the suction port of the impeller, so that an adequate surface is available for the engagement of the flow. The surface of the valve element which faces the delivery chamber therefore surrounds the suction port in a preferably annular manner.

According to an alternative embodiment, the design and arrangement of the at least one valve element is such that a flow which is produced by the impeller, in the delivery chamber acts upon the valve element for its movement between the at least two switching positions and the suction chamber is configured in a manner such that the flow which prevails there exerts no force upon the valve element in the movement direction between the switching positions. This means that according to this embodiment, the valve element at its side which faces the suction chamber is configured as smoothly as possible and without force engagement surfaces, upon which a flow could act. One prevents the flow or the fluid in the suction chamber from braking or preventing the movement of the valve element between the switching positions by way of this design.

A mechanical coupling by way of a suitable coupling can be provided alternatively or additionally to the described hydraulic coupling of the valve element and the impeller or drive motor. Here, the coupling can act in a frictional and/or positive manner. The coupling is preferably configured such that it can be mechanically disengaged. This can be effected for example by way of the movement of the valve element along the second movement path, as has been described above. A pressure-dependently releasable coupling would thus be created. Alternatively or additionally, a design which is releasable in a speed-dependent manner could also be realized, for example by way of a lubrication film forming between the coupling surfaces given an adequately high speed, said lubrication film lifting the frictional coupling. Given an adequately high speed, such a design would overcome the friction between the coupling surfaces in the manner of a plain bearing. A coupling acting in a manner dependent on the rotation direction could be realized for example by way of suitably configured catches/drivers which only positively engage in one rotation direction and slide along one another in the opposite rotation direction. This could be a design in the manner of a pawl or a ratchet. With such a design, the valve element would always move into the desired switching position only in one rotation direction of the drive motor. After reaching the switching position, the drive motor could then be put into operation in the opposite rotation direction, in order to start delivery operation of the centrifugal pump assembly. The coupling then disengages in this opposite rotation direction and the valve element can thus remain in the previously assumed switching position.

According to a further preferred embodiment of the invention, the valve element comprises an opening, via which the suction chamber is in connection with a suction port of the impeller. Here, the suction port of the impeller can be in bearing contact or engagement with the valve element preferably in the peripheral region of the opening, in order to achieve a sealing with respect to the delivery chamber which is delimited by the valve element. The suction port of the impeller can thus be surrounded for example by a collar which engages into the opening of the valve element. Alternatively or additionally, the opening of the valve element can be surrounded by a collar which overlaps with a collar which is on the impeller and which surrounds the suction port. A sealing between the valve element and the suction port can therefore be achieved. The part of the valve element which surrounds the opening can face delivery chamber, which is to say delimit the delivery chamber, in which the impeller rotates. The opposite surface of the valve element faces the suction chamber, so that the valve element separates the suction chamber and delivery chamber from one another in the region which surrounds the suction port of the impeller.

The drive motor is particularly usefully activated via a control device in a manner such that it can be driven in two rotation directions and/or is preferably adjustable in its speed. For this, the control device can comprise a speed controller and in particular a frequency converter for the adjusting/setting the rotation direction and/or the speed. The change of the speed is preferably possible in a manner such that the acceleration on starting up and braking the drive motor can also be varied, in order to realize different courses of acceleration. This means that the control device is configured in a manner such that it can accelerate and/or brake the drive motor to a different extent, for example by way of corresponding ramps for the acceleration and braking being selected. By way of this, it is possible to move the valve element into the desired switching position by way of a suitable rotation of the drive motor in the manners described above and to subsequently go into delivery operation, in which the valve element remains in the previously assumed switching position. Moreover, a speed regulation preferably by way of the control device is possible in the usual manner on delivery operation, in order to be able to operate the centrifugal pump assembly according to desired characteristic curves.

The centrifugal pump assembly according to the invention is preferably a circulation pump assembly, in particular a circulation pump assembly as is applied in heating facilities and/or air-conditioning facilities for circulating a heat transfer medium. Such circulation pump assemblies are preferably configured for delivering water as a heat transfer medium. The electric drive motor is preferably configured as a wet-running electrical drive motor, i.e. a canned motor, concerning which a can or canned pot separates the stator from the rotor so that the rotor rotates in the fluid to be delivered.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
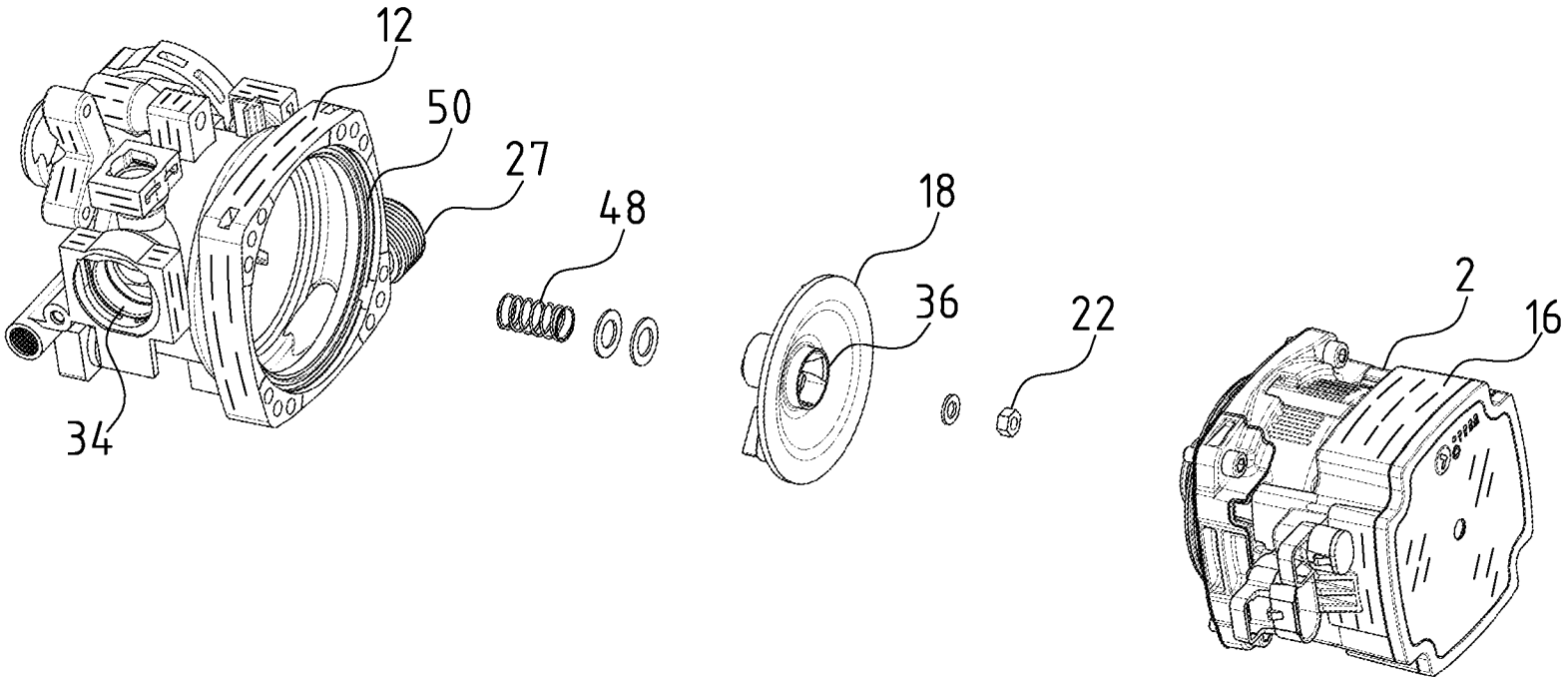
FIG. 1 is an exploded view of a centrifugal pump assembly according to a first embodiment of the invention.
Figure 3:
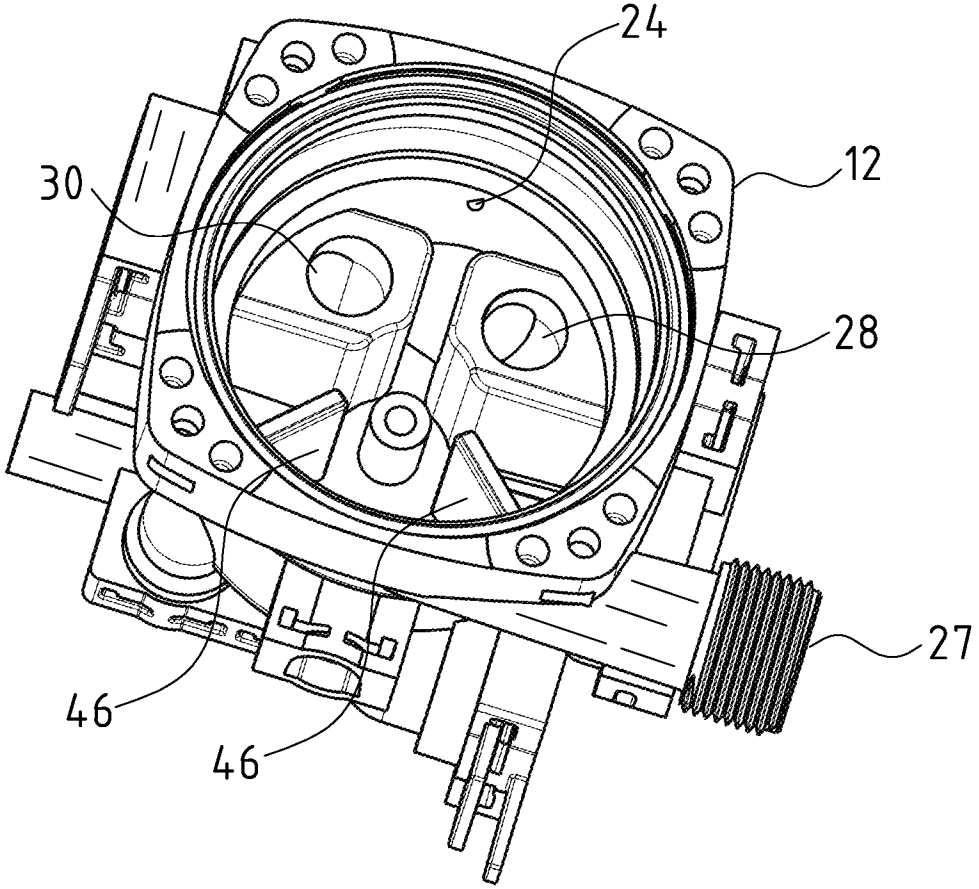
FIG. 3 is a perspective view of the pump casing of the centrifugal pump assembly according to FIG. 1 in the opened condition.
Figure 2:
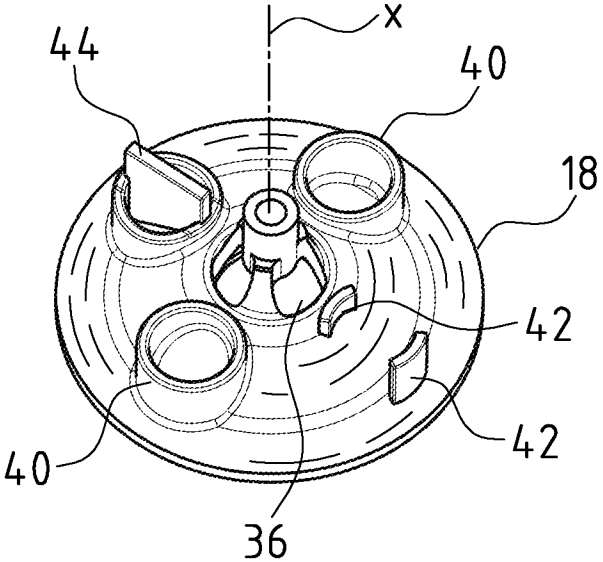
FIG. 2 is a perspective view of the lower side of the valve element of the centrifugal pump assembly according to FIG. 1.
Figure 4:
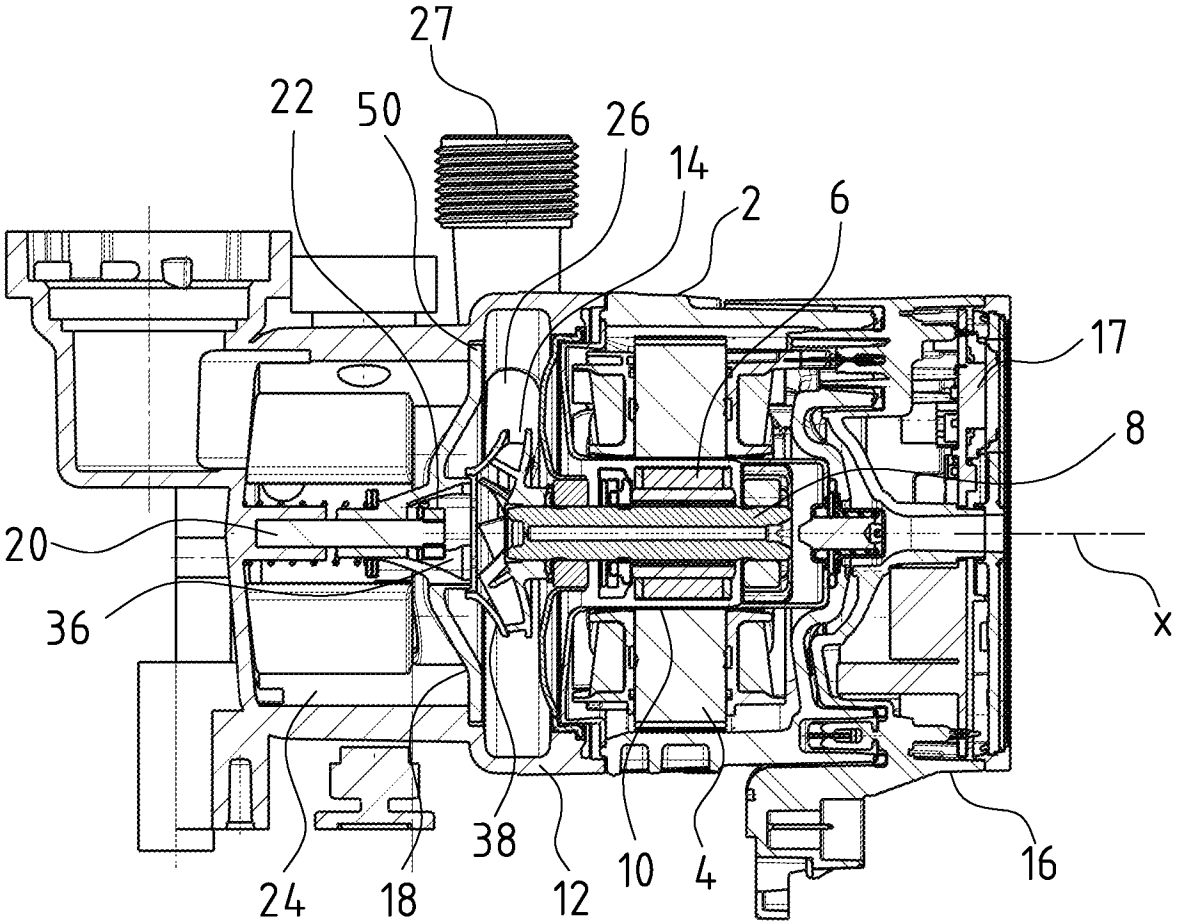
FIG. 4 is a sectional view of the centrifugal pump assembly according to FIG. 1.

Referring to the drawings, the embodiment examples of the centrifugal pump assembly according to the invention which are described in the following description relate to applications in heating systems and/or air conditioning systems, in which a fluid heat transfer medium, in particular water is circulated by the centrifugal pump assembly.

The centrifugal pump assembly according to the first embodiment of the invention comprises a motor casing 2, in which an electrical drive motor is arranged. This in the known manner comprises a stator 4 as well as a rotor 6 which is arranged on a rotor shaft 8. The rotor 6 rotates in a rotor space which is separated from the stator space, in which the stator 4 is arranged, by way of a can or a canned pot 10. This means that here it is the case of a wet-running electrical drive motor. The motor casing 2 is connected to a pump casing 12 at an axial end, in which pump casing an impeller 14 which is connected to the rotor shaft 8 in a rotationally fixed manner rotates.

An electronics casing 16 which contains control electronics or a control device for the activation of the electrical drive motor in the pump casing 2 is arranged at the axial end of the motor casing 2 which is opposite to the pump casing 12. The electronics casing 16 could also be arranged at another side of the pump casing 2 in a corresponding manner.

A movable valve element 18 is moreover arranged in the pump casing 12. This valve element 18 is rotatably mounted on a pivot 20 in the inside of the pump casing 12, and specifically such that the rotation axis of the valve element 18 is aligned with the rotation axis X of the impeller 14. The pivot 20 is fixed to the base of the pump casing 12 in a rotationally fixed manner. The valve element 18 is not only rotatable about the pivot 20 but is movable in the longitudinal direction X by a certain amount. This linear movability is limited in one direction by way of the pump casing 12, upon which the valve element 18 abuts with its outer periphery. In the opposite direction, the movablility is limited by the nut 22, with which the valve element 18 is fastened on the pivot 20. It is to be understood that a different axial fastening of the valve element 18 to the pivot 20 could also be selected instead of the nut 22.

In the pump casing 12, the valve element 18 separates a suction chamber 24 from a delivery chamber 26. The impeller 14 rotates in the delivery chamber 26. The delivery chamber 26 is connected to the delivery connection or delivery branch (delivery nozzle) 27 of the centrifugal pump assembly which forms the outlet of the centrifugal pump assembly. Two suction-side inlets 28 and 30, of which the inlet 28 is connected to a first suction branch 32 and the inlet 30 is connected to the second suction branch 34 of the pump casing 12 run out into the suction chamber 24.

Figure 5:
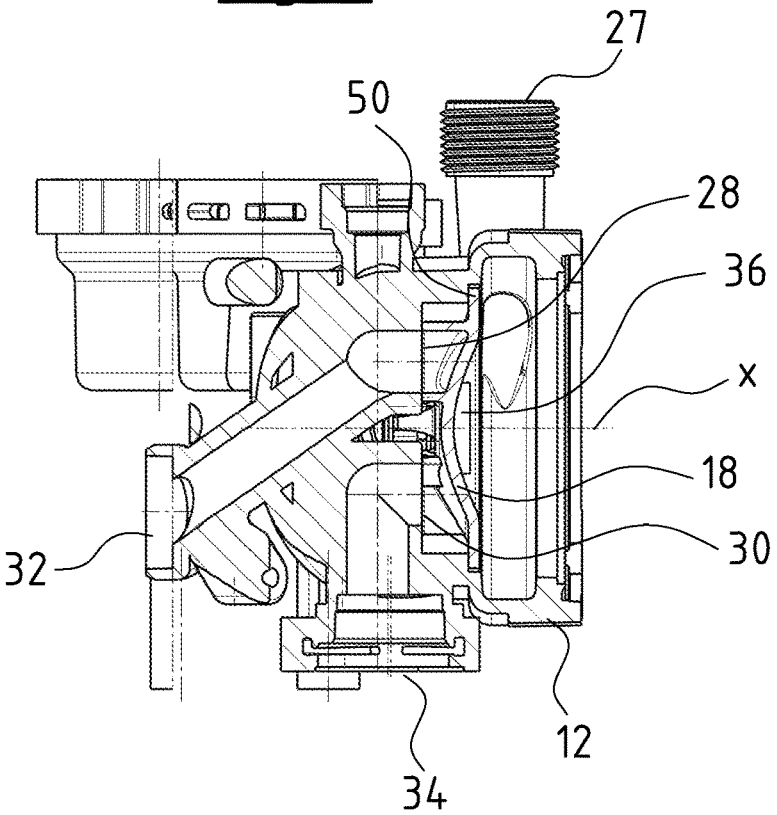
FIG. 5 is a sectional view of the pump casing of the centrifugal pump assembly according to FIG. 4 with the valve element in a first switching position.
Figure 6:
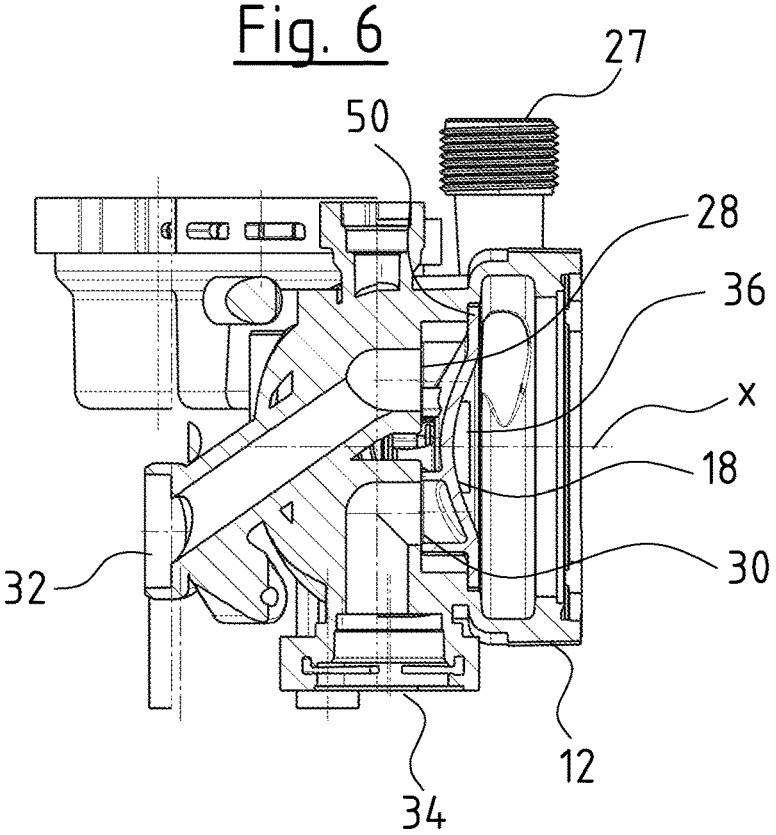
FIG. 6 is a sectional view according to FIG. 5 with the valve element in a second switching position.

The valve element 18 is configured in a disc-like manner and simultaneously assumes the function of a common deflector plate which separates the suction chamber 24 from the delivery chamber 26. The valve element 18 comprises a central suction opening 26 which comprises a projecting peripheral collar which is engaged with the suction port 38 of the impeller 14 and is essentially in sealing bearing contact with the suction port 38. Facing the impeller 14, the valve element 18 is configured in an essentially smooth manner. The valve element at the side which is away from the impeller 14 comprises two annular sealing surfaces 40 which in this embodiment example are situated on closed, tubular stubs (connection pieces or nozzles). The two annular sealing surfaces 40 are arranged on the sealing element 18 at two diametrically opposite positions with respect to the rotation axis X of this element, so that they can come to sealing bear on the base of the pump casing 12 in the peripheral region of the inlets 28 and 30, so as to close the inlets 28 and 30. Support elements 42 are arranged offset to the sealing surfaces 40 at an angular position of 90° and can likewise come to bear on the peripheral region of the inlets 28, 30, but are distanced to one another such that they do not then close the inlets 28, 30. The inlets 28 and 30 do not lie on the diameter line with respect to the rotation axis X, but on a radially offset straight line, so that on rotation of the valve element 18 about the rotation axis X into a first switching position, the inlet 38 is closed by a sealing surface 40 whilst the support elements 42 lie on the inlet 30 and open this. In a second switching position, the inlet 30 is closed by a sealing surface 40 whilst the support elements 42 bear in the peripheral region of the inlet 28 and open this. The first switching position, in which the inlet 38 is closed and the inlet 30 is opened is represented in FIG. 5. The second switching position, in which the inlet 30 is closed and the inlet 28 is opened is represented in FIG. 6. This means that one can switch between the two switching positions by way of a rotation of the valve element about the rotation axis X by 90°. The two switching positions are limited by a stop element 44 which alternately hits two stops 46 in the pump casing 12.

In an idle position, which is to say when the centrifugal pump assembly is not in operation, a spring 48 presses the valve element 18 into released position, in which the outer periphery of the valve element 18 does not sealingly bear on the pump casing 12 and the sealing surfaces 40 do not sealingly bear in the peripheral region of the inlets 28 and 30, so that the valve element 18 can rotate about the axis 20. If the drive motor is now brought into rotation by the control device 17 in the electronics casing 16, so that the impeller 14 rotates, then a peripheral flow which via the friction co-rotates the valve element 18 in its rotation direction is produced in the delivery chamber 26. The control device 17 is configured such that it can drive the drive motor selectively in two rotation directions. The valve element 18 can therefore likewise be moved in two rotation directions about the rotation axis X depending in the rotation direction of the impeller 14, via the flow which is brought into rotation by the impeller 14, since the flow in the peripheral region of the impeller 14 always runs in its rotation direction. The valve element 18 can therefore be rotated between the two switching positions which are limited by the stops 46.

If the impeller 14 rotates at a sufficient speed, then a pressure builds up in the delivery chamber 26 and this pressure produces a pressing force on the surface of the valve element 18 which surrounds the suction opening 36, said pressing force being opposite to the spring force of the spring 48, so that the valve element 18 is moved in the axial direction X against the spring force of the spring 48 such that it comes to sealingly bear at its outer periphery on an annular contact shoulder 50 on the pump casing 12. Depending on the switching position, one of the sealing surfaces 40 simultaneously comes to sealingly bear on the periphery of one of the inlets 28 and 30, so that one of the inlets 28, 30 is closed. The support elements 42 come to bear on the other inlet, so that this inlet remains open and a flow path from this inlet 28, 30 to the suction opening 36 and from there into the inside of the impeller 14 is given. A frictional contact between the valve element 18 and the pump casing 12 is simultaneously created by way of the bearing of the valve element 18 on the contact shoulder 50 and on the sealing surface 40 in the peripheral region of one of the inlets 28, 30. This frictional contact ensures that the valve element 18 is held in the reached switching position. This permits the drive motor to be briefly taken out of operation and to be brought into operation again in the opposite rotation direction without the valve element 18 being rotated. If the switching-off and restarting operation of the motor are effected rapidly enough, then the pressure in the delivery chamber 26 does not reduce to the extent that the valve element 18 can again move in the axial direction into its released position. This permits the impeller to always be driven in its preferred rotation direction, for which the blades are configured, on operation of the centrifugal pump assembly and to only use the opposite rotation direction for moving the valve element 18 in the opposite rotation direction.

Figure 7:
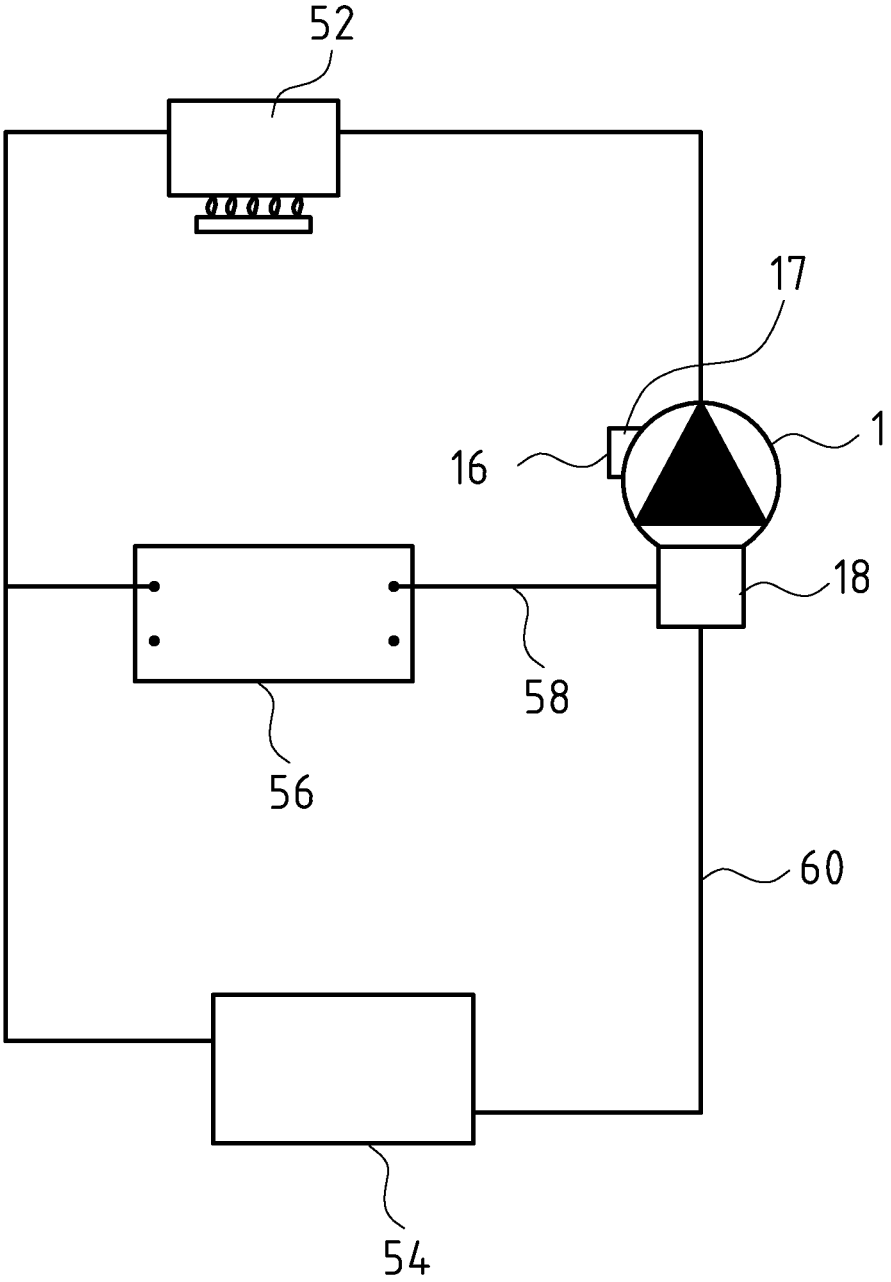
FIG. 7 is a schematic view of the hydraulic construction with a heating facility with a centrifugal pump assembly according to FIG. 1 to 6.

The described centrifugal pump assembly according to the first embodiment of the invention can be applied for example in a heating system as is shown in FIG. 7. Such a heating system is usually applied in apartments or houses and serves for heating the building or for the provision of heated service water. The heating facility comprises heat source 52, for example in the form of a gas heating boiler. A heating circuit 54 which leads for example through various radiators of a building is also present. A secondary heat exchanger 56, via which service water can be heated is moreover provided. A switch-over valve which selectively leads the heat transfer medium flow through the heating circuit 54 or the secondary heat exchanger 56 is usually required in such heating facilities. Regarding the centrifugal pump assembly 1 according to the invention, this valve function is assumed by the valve element 18 which is integrated into the centrifugal pump assembly 1. The control is effected by the control device 17 in the electronics casing 16. The heat source 52 is connected to the delivery branch 27 of the pump casing 12. A flow path 58 is connected to the suction branch 32, whereas a flow path 60 through the heating circuit 54 is connected to the suction branch 34. One can therefore switch between the flow path 58 through the secondary heat exchanger 56 and the flow path through the heating circuit 54 depending on the switching position of the valve element 18, without a valve with an additional drive becoming necessary.

Figure 8:
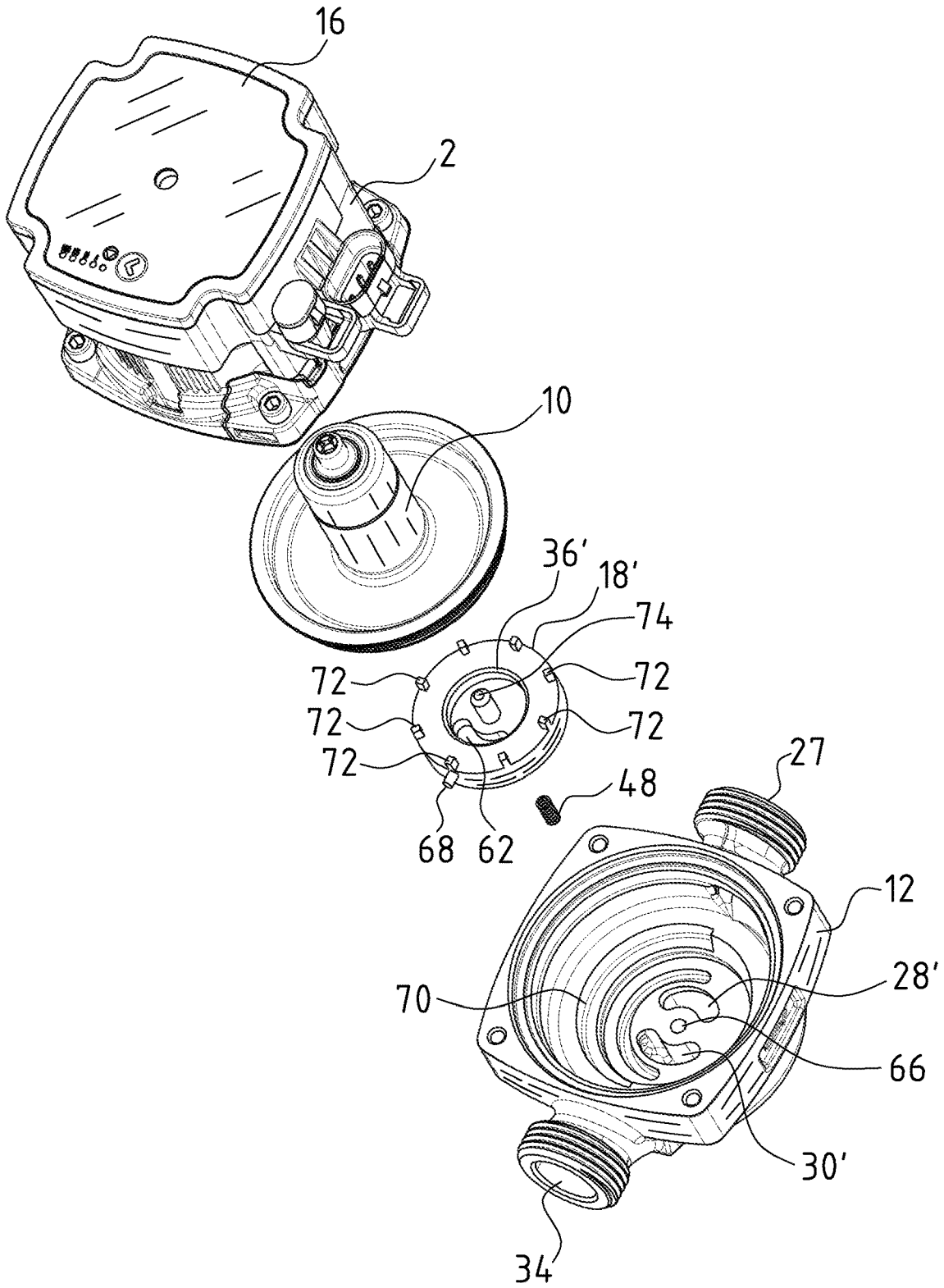
FIG. 8 is an exploded view of a centrifugal pump assembly according to a second embodiment of the invention.
Figure 9:
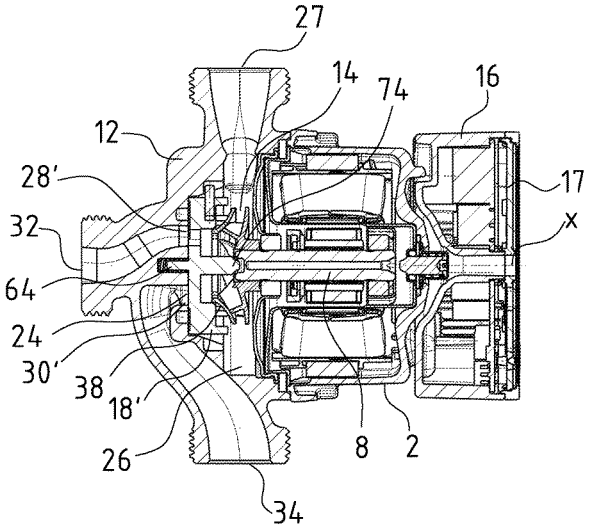
FIG. 9 is a sectional view of the centrifugal pump assembly according to FIG. 8 with the valve element in a first position.
Figure 10:
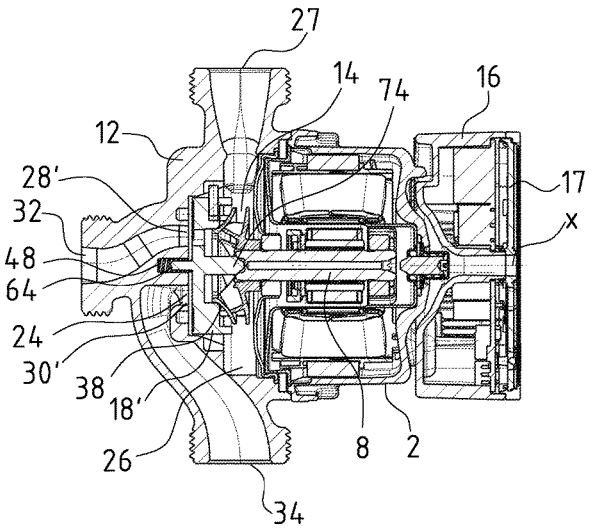
FIG. 10 is a sectional view according to FIG. 9 with the valve element in a second position.

The second embodiment example according to FIG. 8 to 10 differs from the first embodiment example in respect to the construction of the valve element 18'. In this embodiment example too, the valve element 18' separates the delivery chamber 26 from a suction chamber 24 of the pump casing 12. The valve element 18 comprises a central suction opening 36', into which the suction port 38 of the impeller 14 sealingly engages. Opposite the suction opening 36, the valve element 18' comprises an opening 62 which can be selectively brought to overlap with one of the inlets 28, 30 depending on the switching position of the valve element 18'. In this embodiment example, the inlets 28', 30' with regard to their shaping differ from the inlets 28, 30 according to the preceding embodiment. The valve element 18' comprises a central projection 64 which engages into a central hole 60 in the base of the pump casing 12 and is rotatingly mounted there about the rotation axis X. The projection 64 in the hole 66 simultaneously permits an axial movement along the rotation axis X, said movement being limited in one direction by the base of the pump casing 12 and in the other direction by the impeller 14. At its outer periphery, the valve element 18' comprises a pin 68 which engages into a semicircular groove 70 on the base of the pump casing 12. The ends of the groove 70 serve as stop surfaces for the pin 68 in the two possible switching positions of the valve element 18', wherein in a first switching position the opening 62 lies above the inlet 28' and in the second switching position the opening 62 lies above the inlet 30' and the respective other inlet is closed by the base of the valve element 18'. The rotation movement of the valve element 18' between the two switching positions in this embodiment example too is effected by the flow in the delivery chamber 26, said flow being caused by the impeller 14. The valve element 18' is provided with projections 72 which are directed into the delivery chamber 26, in order to be able to transmit this flow onto the valve element 18' in a better manner. If the centrifugal pump assembly 1 is taken out of operation, the spring 48 presses the valve element 18' into the released position which is shown in FIG. 10 and in which it does not bear on the base in the periphery of the inlets 28' and 30'. In this position, with a central pin 74 it axially abuts upon the face side of the motor shaft 8 and is limited in its axial movement by thus stop. If the pressure in the delivery chamber 26 is adequately large, the valve element 18' is pressed into the bearing position (contacting position) which is shown in FIG. 9 and in which the valve element 18' comes to bear on the base of the pump casing 12 in the peripheral region of the inlets 28' and 30', and the pin 74 is simultaneously lifted from the face side of the rotor shaft 8. In this position, the rotor impeller 14 then rotates in normal operation of the centrifugal pump assembly.

Figure 11:
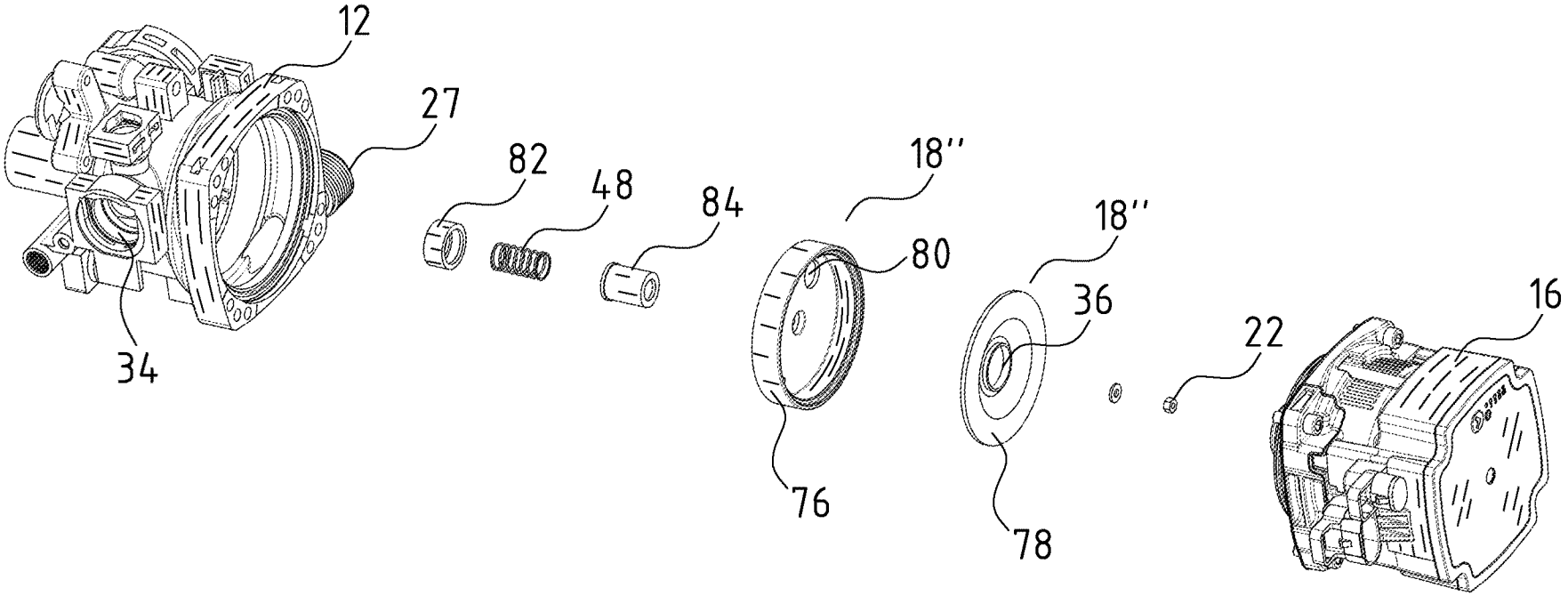
FIG. 11 is an exploded view of the centrifugal pump assembly according to a third embodiment of the invention.
Figure 13:
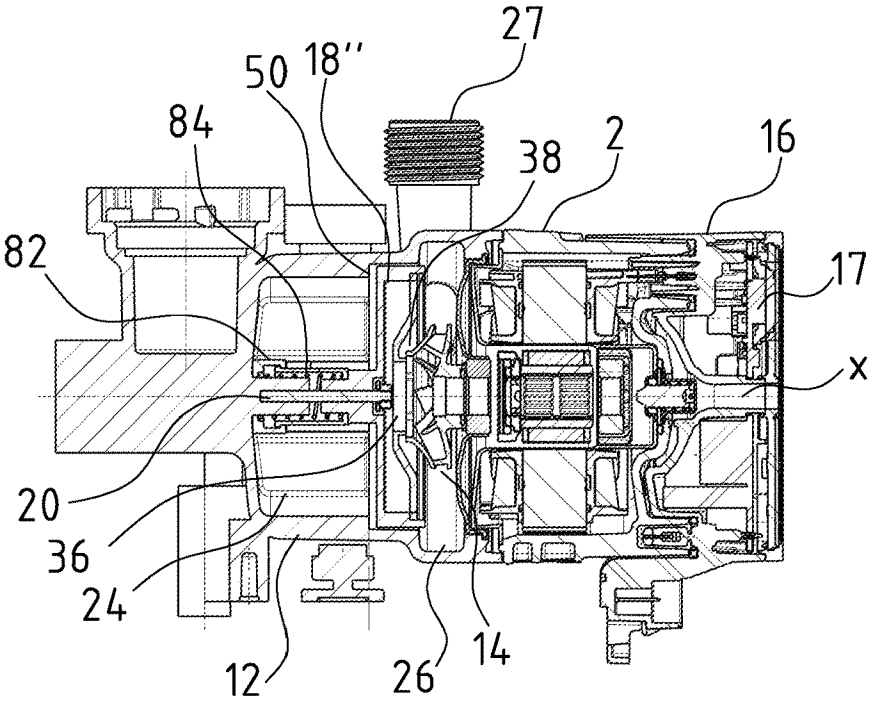
FIG. 13 is a sectional view according to FIG. 12 with the valve element in a second position.
Figure 12:
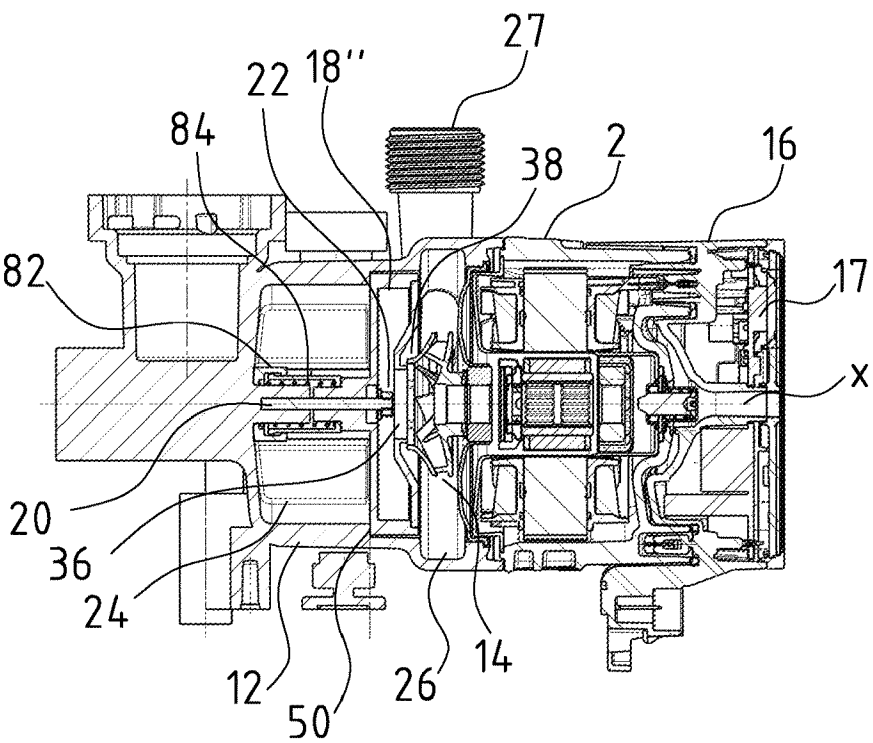
FIG. 12 is a sectional view of the centrifugal pump assembly according to FIG. 11 with the valve element in a first position.

The third embodiment example according to FIG. 11 to 13 shows a further possible embodiment of the valve element 18". This embodiment example differs from the preceding embodiment examples with regard to the construction of the valve element 18". This valve element is configured as a valve drum. The pump casing 12 corresponds essentially to the construction according to FIG. 1 to 6, wherein in particular the arrangement of the inlets 28 and 30 corresponds to the arrangement which is described by way of the first embodiment example. The valve drum of the valve element 18" consists of a pot-like lower part which is closed by a cover 78. The cover 78 faces the delivery chamber 26 and comprises the central suction opening 36 which engages with its axially directed collar into the suction port 38 of the impeller 14. At the opposite side, the base of the lower part 36 comprises an inlet opening 80 which is brought to overlap with one of thee inlets 28, 30 depending on the switching position, whilst the respective other inlet 28, 30 is closed by the base of the lower part 26. The valve element 18" is rotatably mounted on a pivot 20 which is fastened in the base of the pump casing 12, wherein the rotation axis which is defined by the pivot 20 corresponds to the rotation axis X of the impeller 14. In this embodiment example too, the valve element 18" is axially displaceable along the pivot 20 by a certain amount, wherein a spring 48 which in the idle position presses the valve element 18" into its released position shown in FIG. 13 is present here too. In this embodiment example too, this axial position is limited by the nut 22. In the released position, the valve element 18" is rotatable by way of the flow which is created by the impeller 14 as described previously, which is to say a hydraulic coupling between the impeller 14 and the valve element 18" is created. In the bearing position which is shown in FIG. 12, on the one hand one of the inlets 28, 30 is sealingly closed depending on the switched position. On the other hand, a sealing between the suction chamber 24 and the delivery chamber 26 is effected due to the valve element 18" bearing on the contact shoulder 50.

In this embodiment example, the mounting of the valve element 18" on the pivot 20 is moreover encapsulated by two sleeves 82 and 84, so that these regions are protected from contamination by the delivered fluid and can be possibly pre-lubricated. A very easy-motion mounting is sought after, in order to ensure the easy rotatability of the valve element 18" by the flow which is caused by the impeller 14. It is to be understood that the mounting can be encapsulated accordingly also in the case of the other embodiment examples which are described here.

Figure 14:
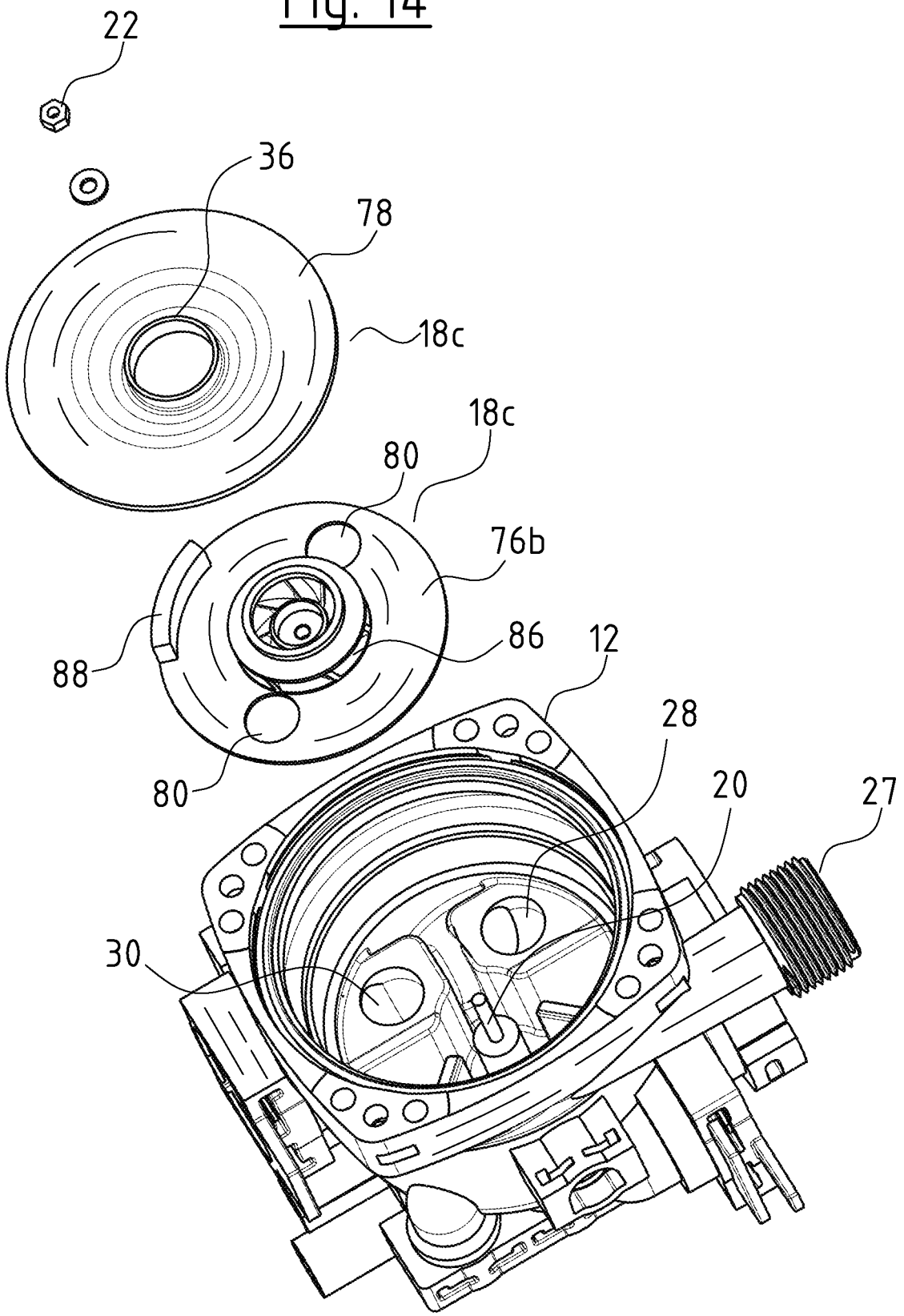
FIG. 14 is an exploded view of a pump assembly with a valve element according to a fourth embodiment of the invention.
Figure 15:
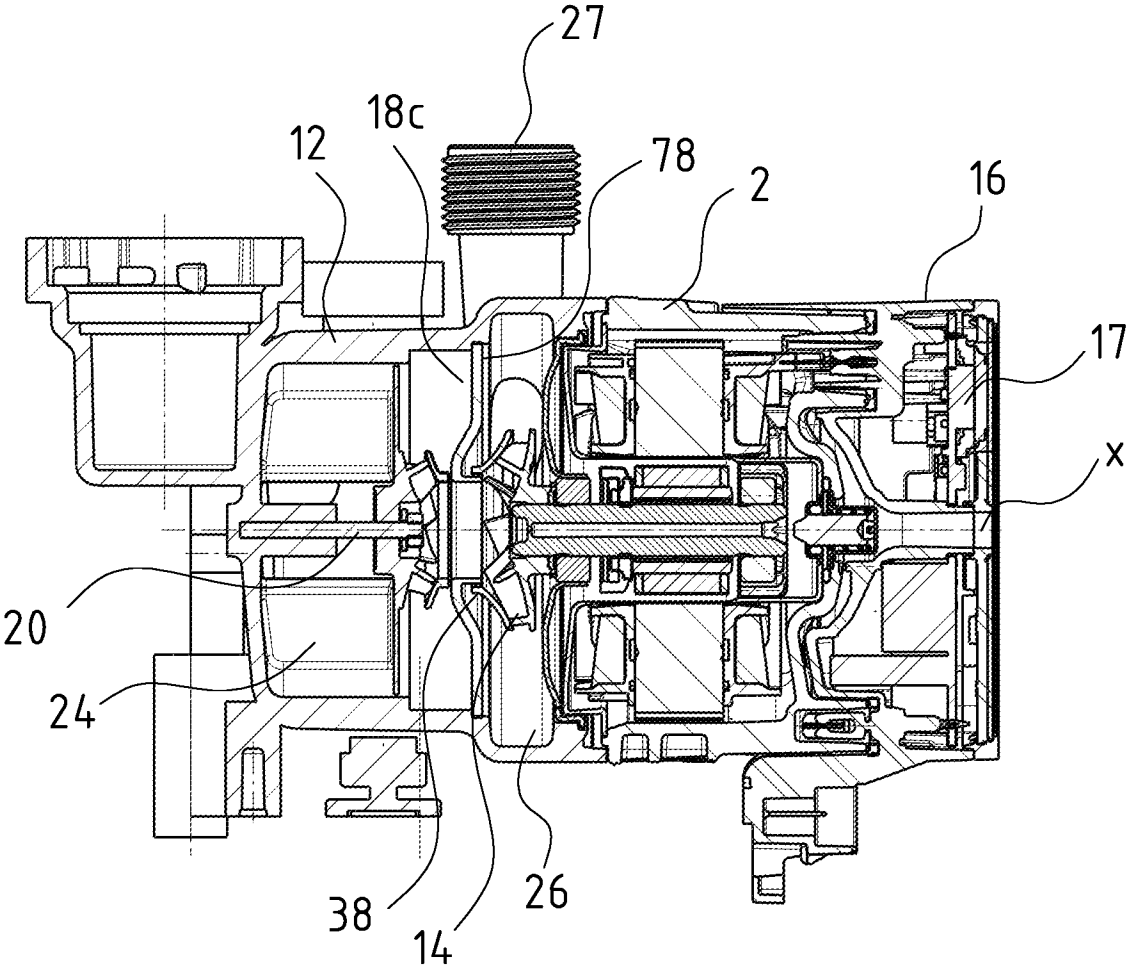
FIG. 15 is a sectional view of a centrifugal pump assembly according to the fourth embodiment of the invention.

FIGS. 14 and 15 show a fourth embodiment example, concerning which the construction of the pump casing 12 corresponds to the construction of the pump casing 12 according to the first and the third embodiment example. In this embodiment example, the rotation movement of the valve element 18*c* is assisted by the suction-side flow, which is to say the flow which enters into the suction port 38 of the impeller 14. In this embodiment too, the valve element 18*c* is configured in an essentially drum-like manner and comprises a cover 28 which faces the delivery chamber 26 and which is with a central suction opening 36 which is engaged with the suction port 38 as has been described beforehand. The lower part 76*b* which is shown here comprises two entry openings 80 which can be brought to overlap with one of the inlets 28, 30 depending on the switching position, wherein the respective other inlet 28, 30 is sealingly closed by the base of the lower part 46*b*, as has been described with the preceding embodiment example. Guide vanes 86 with blades, into which the flow enters radially from the inlet openings 80 and exits axially to the central suction opening 36 are arranged between the lower part 76*b* and the cover 78. A torque about the pivot 20 is also produced by the blades of the guide vanes 86, by way of which torque the valve element 18*c* can be moved between the switching positions. This functions essentially as has been described previously. A spring 48, as has been described previously, can additionally be provided, in order to move the valve element 18*c* into a released position. With this embodiment example, the restoring movement is effected by a weight 88, since a torque is always produced in the same direction independently of the direction, in which the impeller 14 rotates, on account of the shaping of the blades of the guide vanes 86. On operation, the centrifugal pump assembly is always situated in the installation position which is shown in FIG. 15 and in which the rotation axis X extends horizontally. When the centrifugal pump assembly is switched off, the valve element 18*c* always rotates about the pivot 20 such that the weight 88 lies at the bottom. The valve element 18*c* can be rotated against this restoring force which is produced by the weight 88, by way of the torque produced by the guide vanes 86, wherein a pressure can be built up in the delivery chamber 26 in such a rapid manner by way of a very rapid starting operation of the drive motor, that the valve element 18*c* gets into its bearing position (contacting position), as has been described above, in which position it is non-positively held on the pump casing 12 in a rotationally fixed manner without having to be moved out of its idle condition. It is to be understood that a restoring of the valve element by way of gravity or by way of another restoring force independently of the drive could also be applied to the other embodiment examples which are described here.

Figure 16:
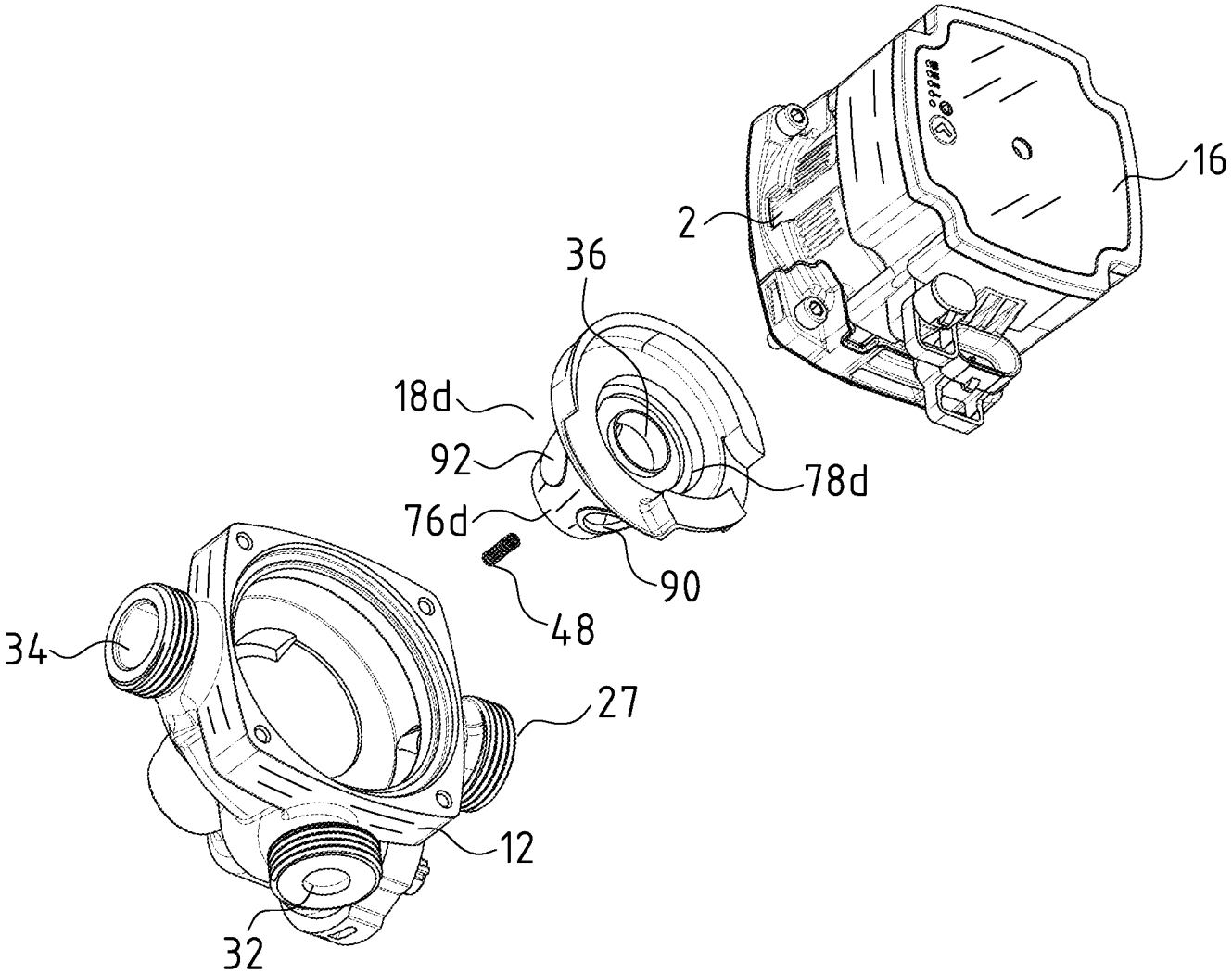
FIG. 16 is an exploded view of a centrifugal pump assembly according to a fifth embodiment of the invention.
Figure 18:
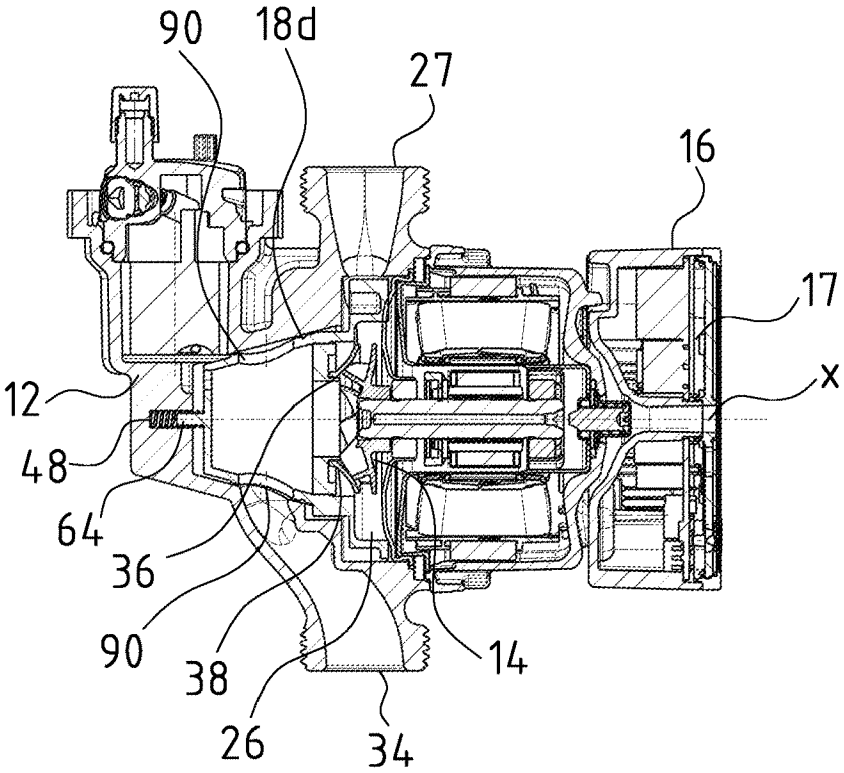
FIG. 18 is a sectional view according to FIG. 17 with the valve element in a second position.
Figure 17:
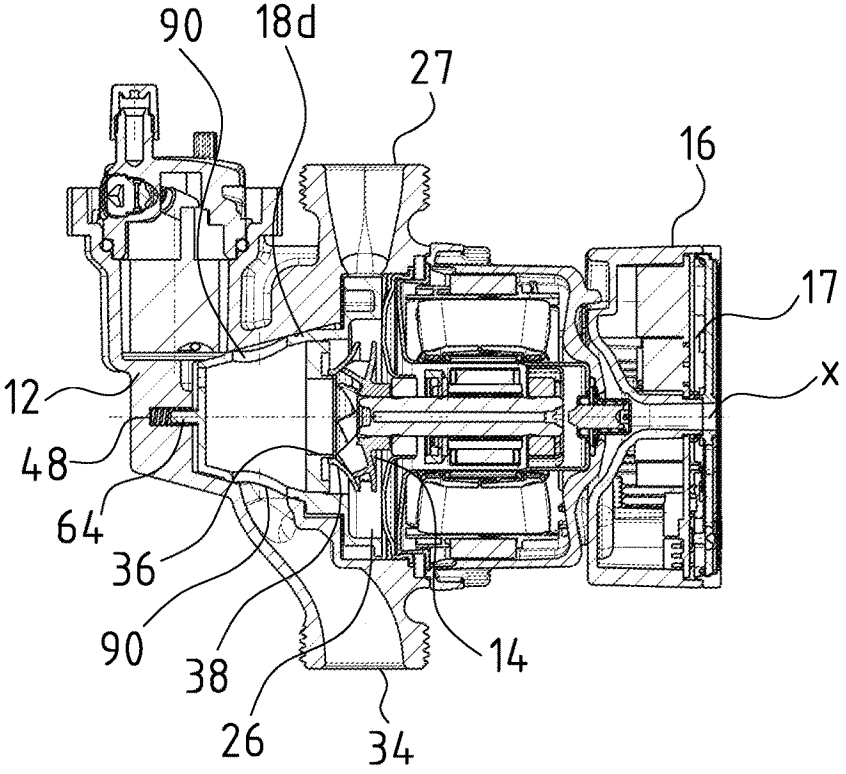
FIG. 17 is a sectional view of the centrifugal pump assembly according to FIG. 16 with the valve element in a first position.
Figure 19:
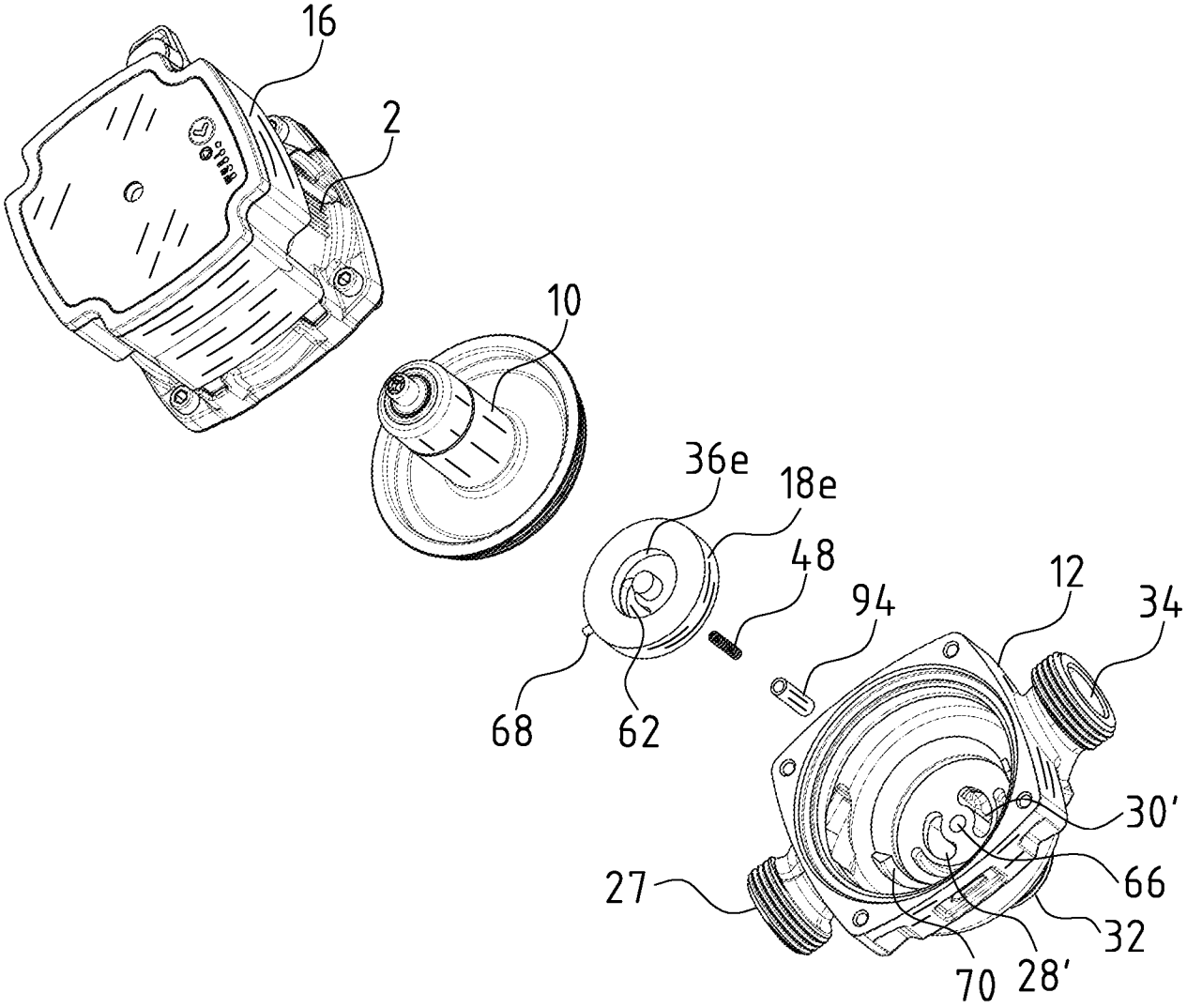
FIG. 19 is an exploded view of a centrifugal pump assembly according to a sixth embodiment of the invention.
Figure 20:
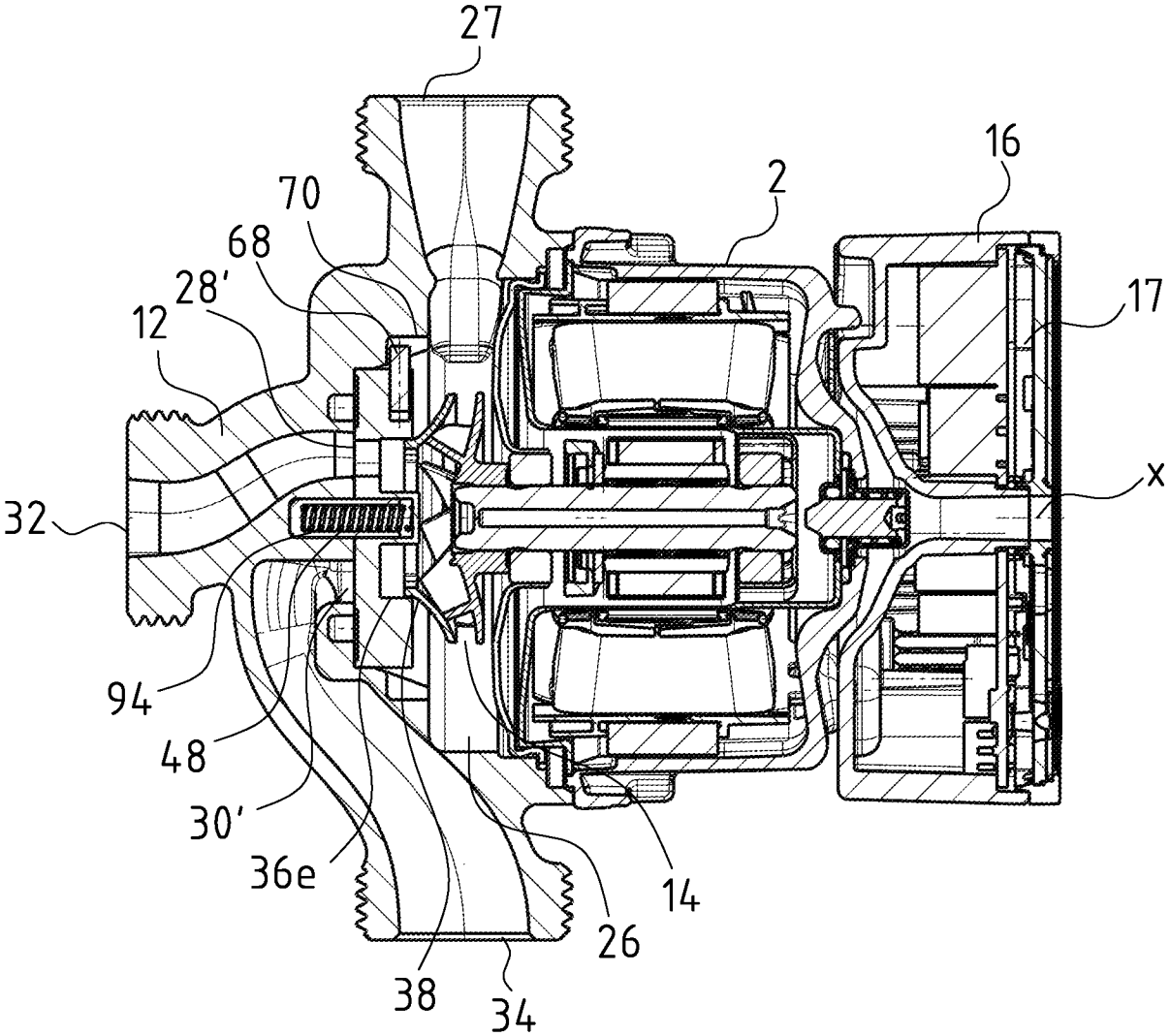
FIG. 20 is a sectional view of the centrifugal pump assembly according to FIG. 19.

The fifth embodiment example according to FIG. 16 to 18 differs from the preceding embodiment examples again in the construction of the valve element. With regard to this embodiment example, the valve element 18*d* is configured conically. The valve element 18*d* comprises a conical, pot-like lower part 76*d* which is closed by a cover 78*d*, wherein a central suction opening 36 which is engaged with the suction port 38 of the impeller 14 in the previously described manner is again formed in the cover 78*d*. Inlet openings 90 which by way of rotating the valve element 18*d* can be selectively brought to overlap with inlets which are connected to the suction branches 32 and 34, in order to create a flow path through the inside of the valve element 18*d* to the suction opening 36 are formed in the conical peripheral surface of the lower part 76*b*. Sealing surfaces 92 which can close the respective other inlet are formed on the conical lower part between the inlet openings 90. As also with the second embodiment example according to FIGS. 8 and 10, here the valve element 18*d* also comprises a pin-like projection 64 which engages in a recess on the base of the pump casing 12 and there rotatably mounts the valve element 18*d* about the rotation axis X. Here too, an axial movement is possible between a released position, as is shown in FIG. 18 and a bearing position as is shown in FIG. 17. In the released position, the lower part 76*d* of the valve element 18*d* essentially does not bear on the pump casing 12 so that it can be rotated by the flow in the delivery chamber 26 as has been described with regard to the previously described embodiment examples. Here, a to-and-fro movement of the valve element 18*d* can again be achieved in a manner dependent on the rotation direction of the impeller, wherein here too, the rotation movement of the valve element 18*d* can also be limited by stops which are not shown. In the bearing position according to FIG. 17, on the one hand a sealing bearing contact of the valve element 18*d* is effected, and on the other hand it is non-positively held, so that again, as long as the pressure in the delivery chamber 26 is sufficiently large, it is not moved between the switching positions even given a direction change of the impeller 14.

The sixth embodiment example according to FIG. 19 to 22 is similar to the embodiment example 2 according to FIG. 8 to 10. The pump casing 12 corresponds essentially to the construction which is represented there and has been described. The motor casing 2 with the electronics casing 16 and the can 10 also correspond to the construction according to the second embodiment example. The valve element 18*e* has a construction which is very similar to the construction of the valve element 18'. What is merely absent are the projections 76 and pin 74. In contrast, the opening 62 is formed in exactly the same manner. The suction opening 36*e* also corresponds essentially to the construction of the suction opening 36'. The valve element 18*e* is rotatingly mounted on a hollow pivot which is inserted into the hole 66 in the base of the pump casing 12. In this embodiment example, the spring 48 is arranged in the inside of the hollow axis 94.

Figure 22:
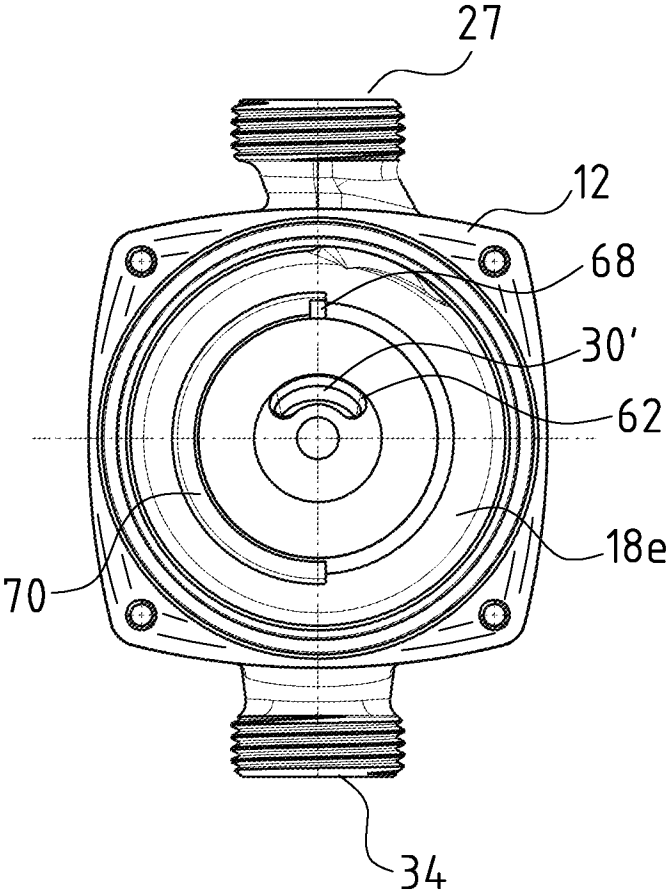
FIG. 22 is a plan view according to FIG. 21 with the valve element in a second switching position.
Figure 21:
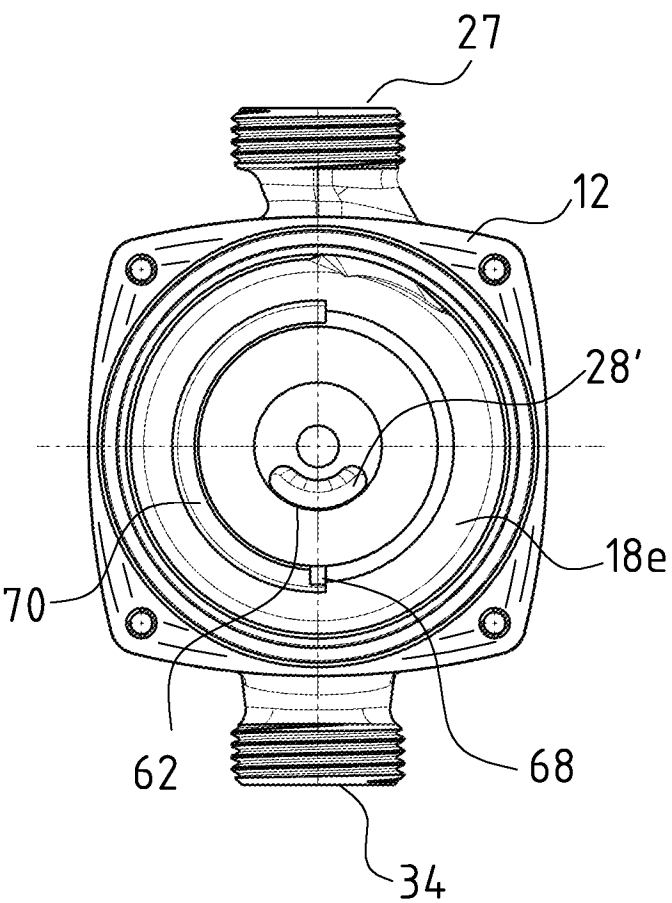
FIG. 21 is a plan view of the opened pump casing of the centrifugal pump assembly according to FIGS. 19 and 20 with the valve element in a first switching position.

Depending on the switching position of the valve element 18*e*, the opening 62 either comes to lie over the inlet 28' or the outlet 30', in order to either open a flow path from the suction branch 32 to the impeller 14 or from the suction branch 34 to the impeller 14. In this embodiment too, the valve element 18*e* is additionally axially movable along the rotation axis X which is the rotation axis of the impeller 14 and of the valve element 18*e*. In an idle position, in which the centrifugal pump assembly is not in operation, the valve element 18*e* is pushed by the spring 48 into a released position, in which the surface of the valve element 18*e* which is away from the impeller 14 is distanced to the base of the pump casing 12, so that the valve element 18*e* can be rotated to and fro about the axis 94 in an essentially free manner between the stops which are formed by the pin 68 and the groove 70. FIG. 21 shows the first switching position, in which the opening 62 lies opposite the inlet 28' and FIG. 22 shows the second switching position, in which the opening 62 lies opposite the second inlet 30'.

With this embodiment example, the rotation of the valve element 18*e* is again effected via the impeller 14, but here a mechanical coupling is provided, said coupling being realized by way of the impeller 14 with its region which surrounds the suction port 38 coming to frictionally bear on the periphery of the suction opening 36*e*. The valve element 18*e* is therefore co-rotated with the impeller 14 until the pin 68 reaches a stop. The coupling then disengages due to slip. Then, with an increasing pressure in the delivery chamber 26, the valve element 18*e* is moved axially into its bearing position as described above, wherein the coupling disengages from the impeller 14, so that the impeller 14 can then rotate in an essentially frictionless manner.

Figure 23:
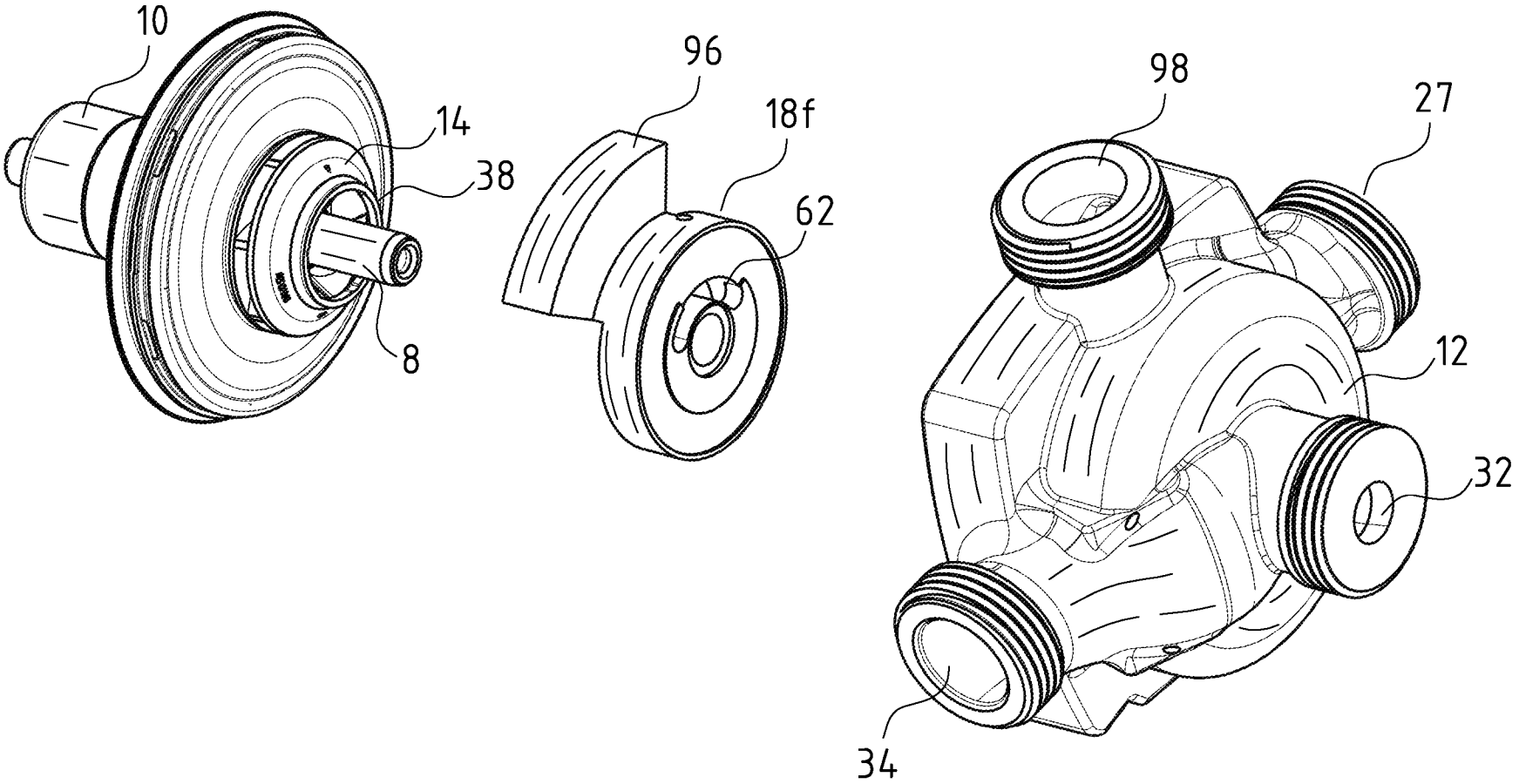
FIG. 23 is an exploded view of a pump casing with a valve element according to a seventh embodiment of the invention.
Figure 24:
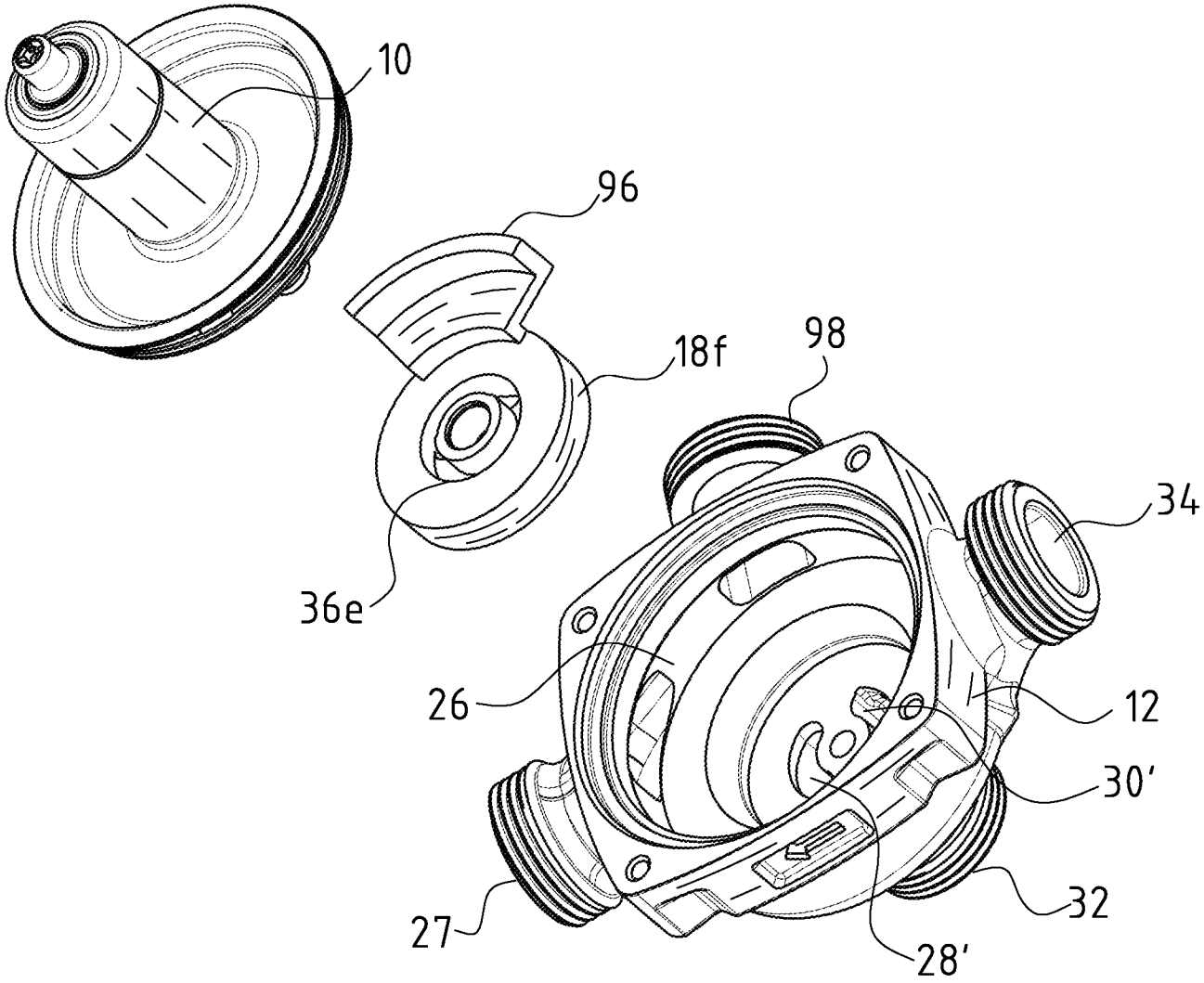
FIG. 24 is an exploded view of the pump casing with the valve element according to the seventh embodiment seen from a different side.
Figure 25:
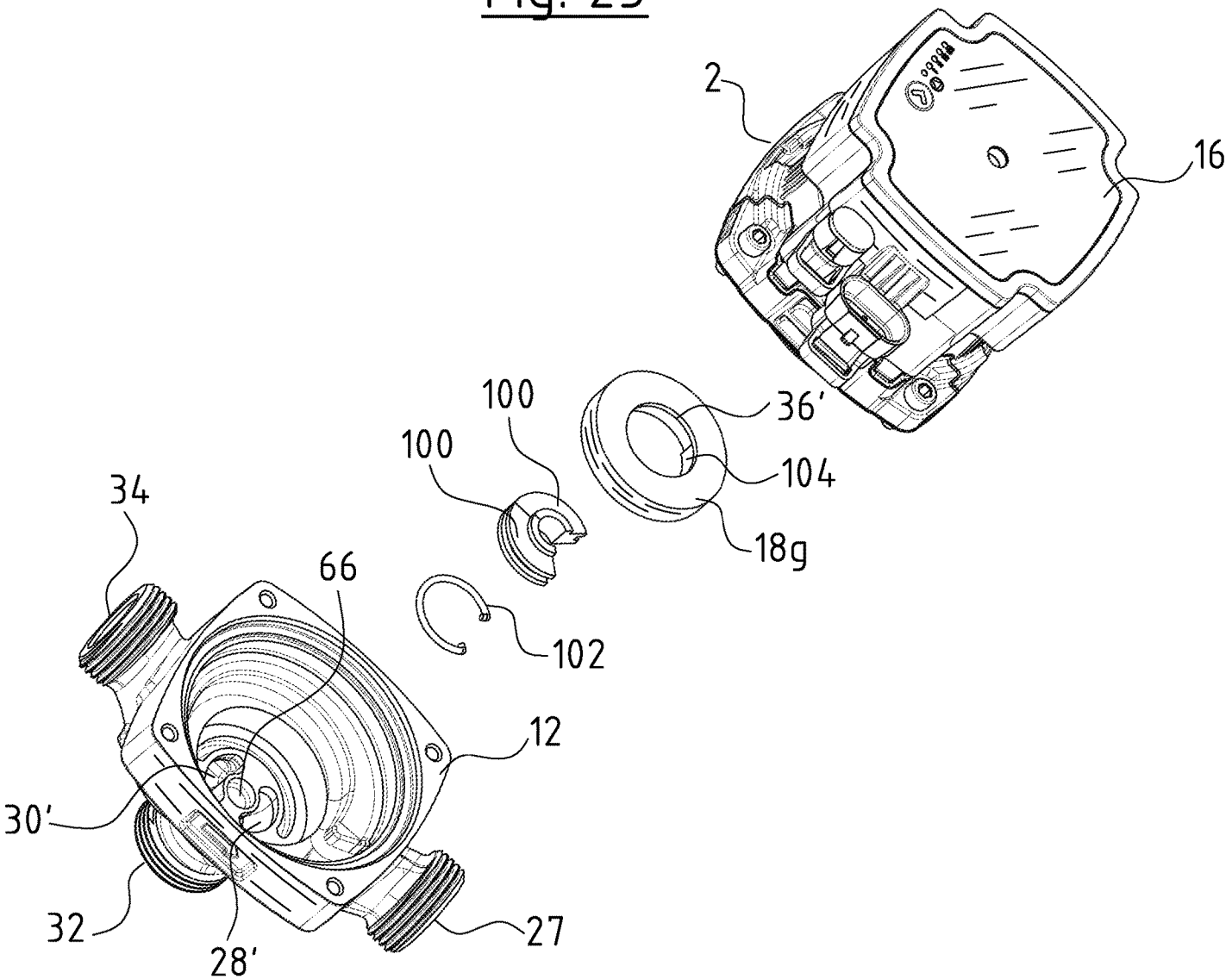
FIG. 25 is an exploded view of a centrifugal pump assembly according to an eighth embodiment of the invention.
Figure 26:
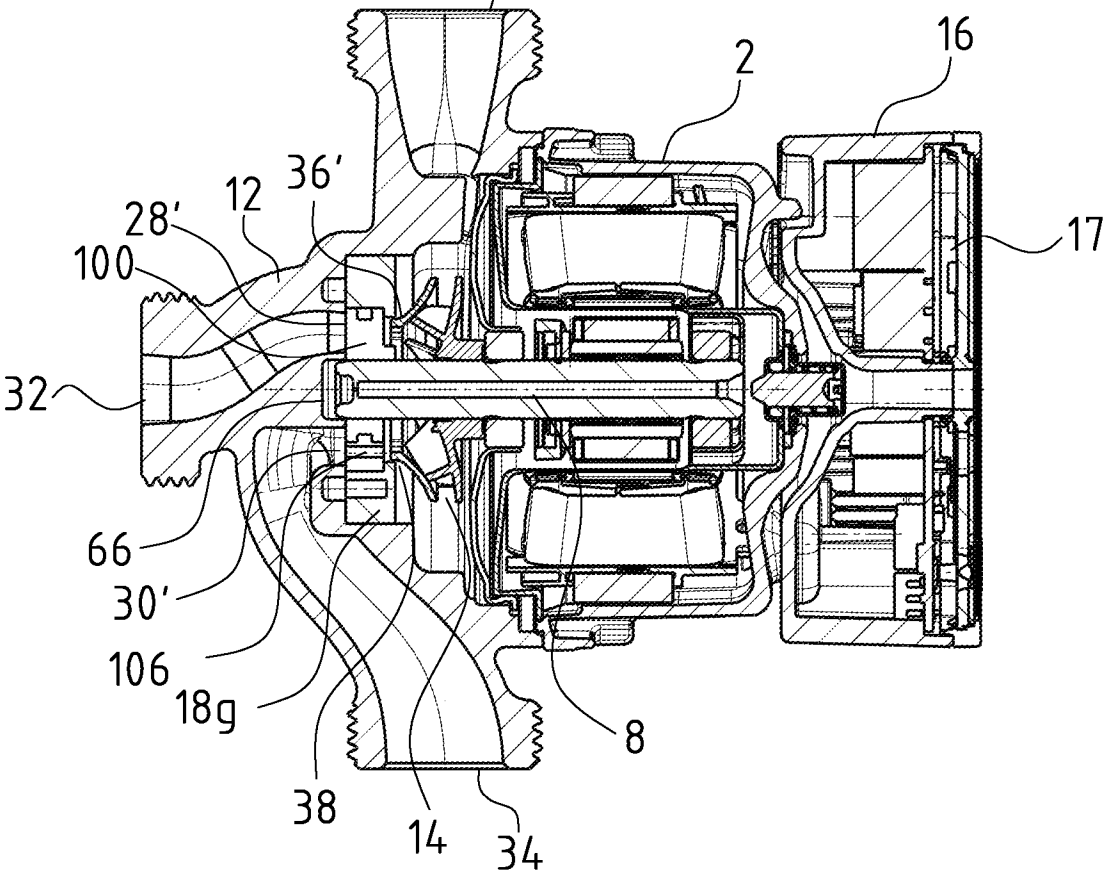
FIG. 26 is a sectional view of the centrifugal pump assembly according to FIG. 25.

The seventh embodiment example according to FIGS. 23 and 24 differs from the previously described sixth embodiment in that a tongue 96 which extends into the delivery chamber 26 and which serves as an additional valve element in the delivery chamber 26 is arranged on the valve element 18*f*. The pump casing 12 comprises an additional delivery branch 98 which runs out into the delivery chamber 26 separately to the delivery branch 27. Depending on the switching position of the valve element 18*f*, the tongue 96 can release the delivery branch 27 or the delivery branch 28 and cover the respective other delivery branch. With this embodiment example therefore, a delivery-side switch-over is envisaged at the delivery side of the impeller 14. A mixing function can be simultaneously realized via the inlets 28' and 30', by way of the opening 92 being positioned such that it covers both these inlets 28', 30' in a first switching position, so that fluid can flow out of the both inlets 28', 30' through the opening 62 and further through the suction port 38. In contrast, in the second switching position the opening 62 covers only the inlet 28', whereas the inlet 30' is closed by the base of the valve element 18*f* in the manner described above. The delivery branch 27 is simultaneously closed and the delivery branch 98 released. The movement of the valve element 18*f* can be realized in the manner described above via the impeller 14 and a mechanical coupling which disengages by way of the axial displacement of the valve element 18*f* given a sufficiently high pressure in the delivery chamber 26. The valve element 18*f* is mounted on the rotor shaft 8 in this embodiment example.

The eighth embodiment according to FIG. 25 to 28 differs from the sixth embodiment with regard to the design of the mechanical coupling between the rotor shaft 8 and the valve element 18*g*. Concerning this embodiment example, the valve element 18*g* is mounted directly on the rotor shaft 8 which is configured in an extended manner and extends up to into the hole 66 in the base of the pump casing 12. Two ring segments 100 with plain bearing characteristics, in particular of ceramic are arranged in the inside of the valve element 18*g*. The ring segments 100 are held together by a clamping ring 102 and are pressed against the rotor shaft 8. In this example, the two ring segments 100 form an essentially ⅔ ring. The valve element 18*g* with a projection 104 on its inner periphery engages in the region of the ring segment which is absent for a complete ring, so that the two ring segments 100 are arranged in the inside of the valve element 18*g* in a rotationally fixed manner A passage 106 which effects the valve function remains in the region of the absent ring segment, which is to say adjacent to the projection 104.

Figure 28:
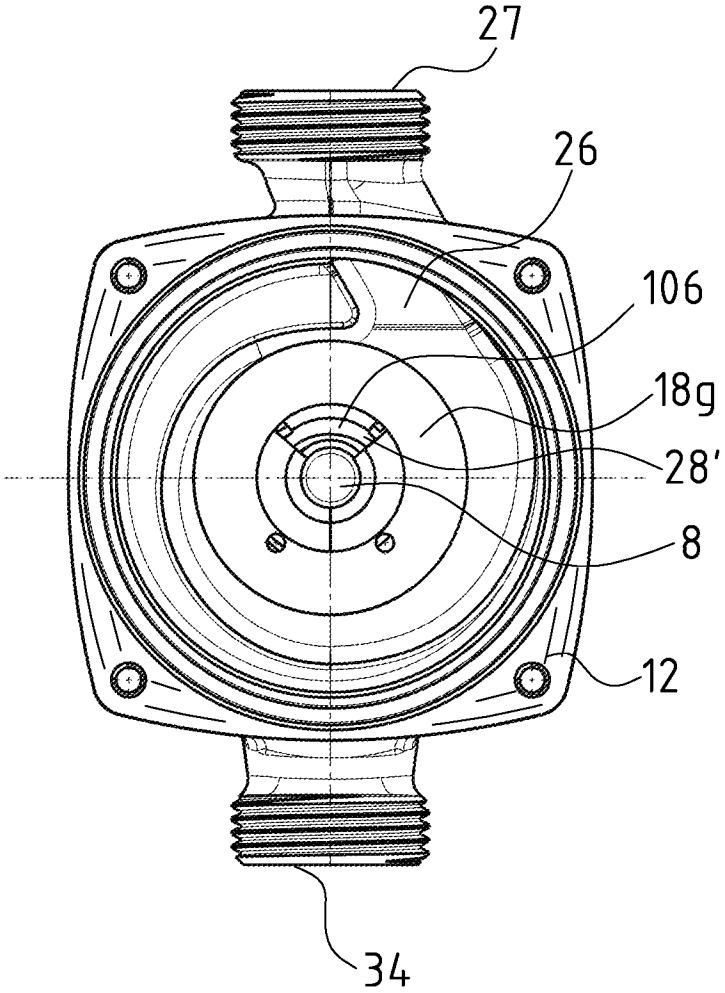
FIG. 28 is a plan view according to FIG. 27 with the valve element in a second switching position.
Figure 27:
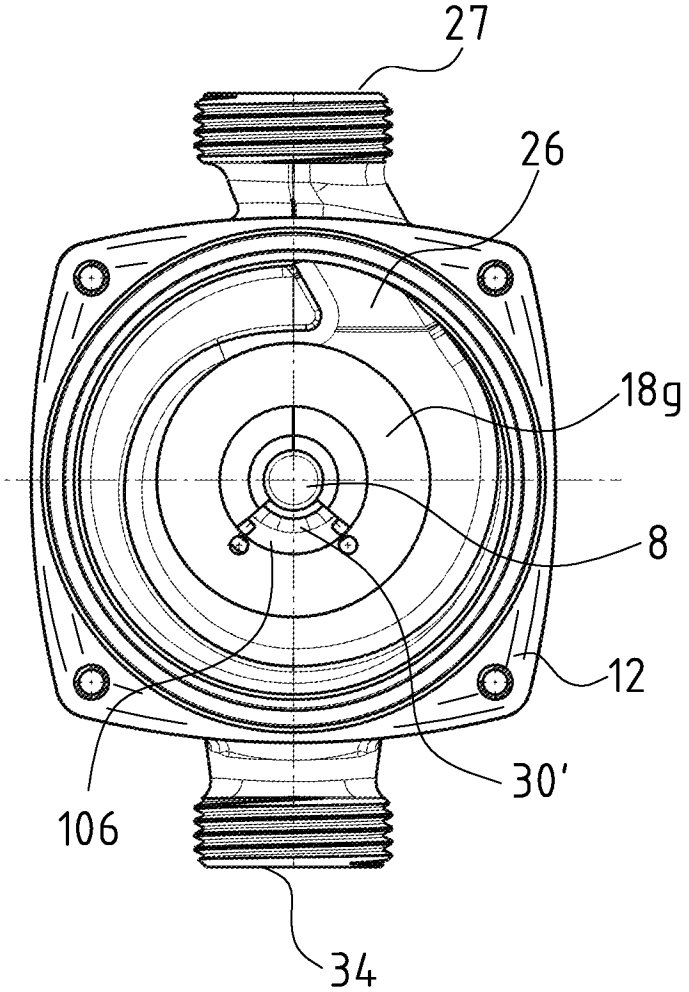
FIG. 27 is a plan view of the opened pump casing of the centrifugal pump assembly according to FIGS. 25 and 26 with the valve element in a first switching position.
Figure 29:
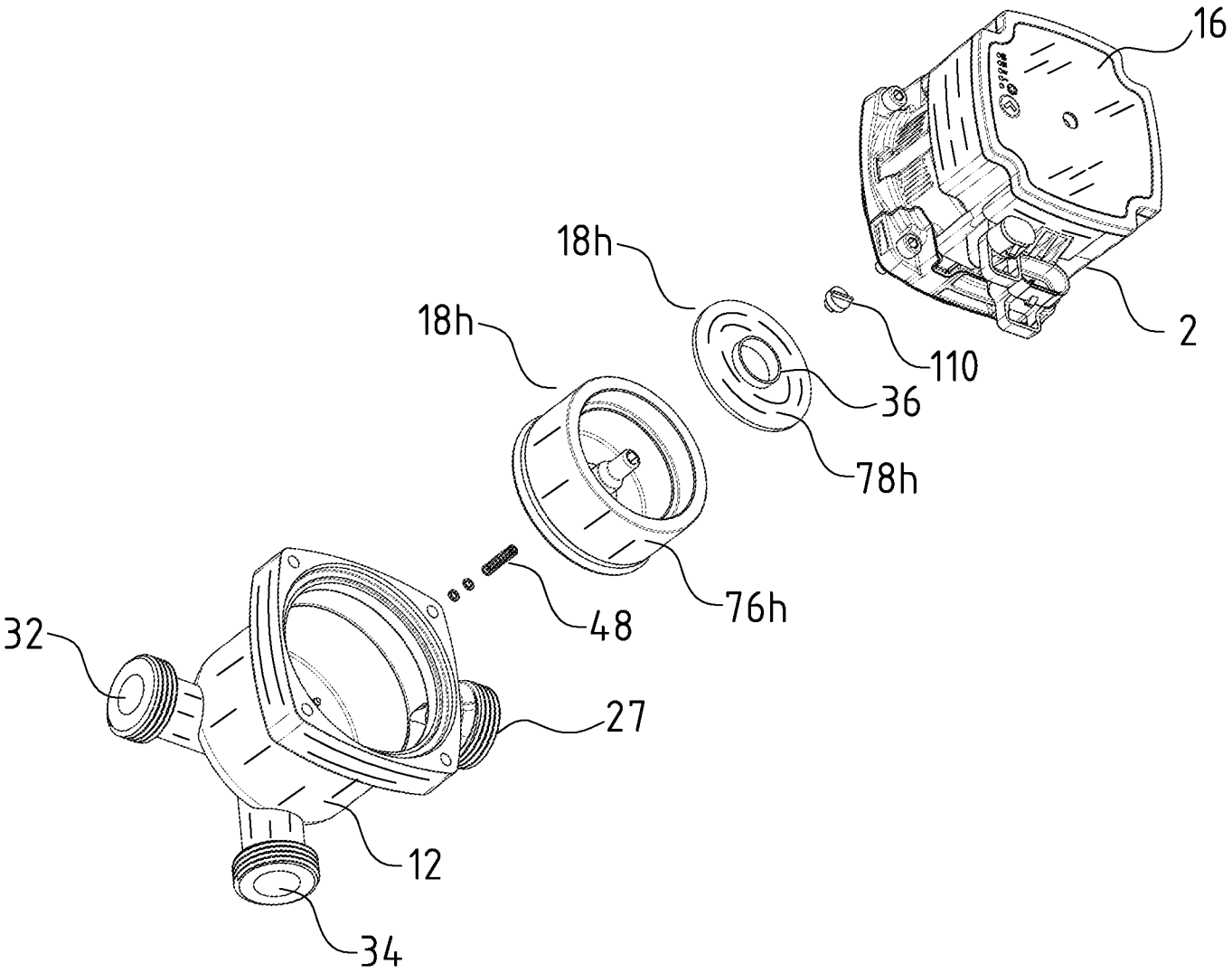
FIG. 29 is an exploded view of the centrifugal pump assembly according to a ninth embodiment of the invention.
Figure 30:
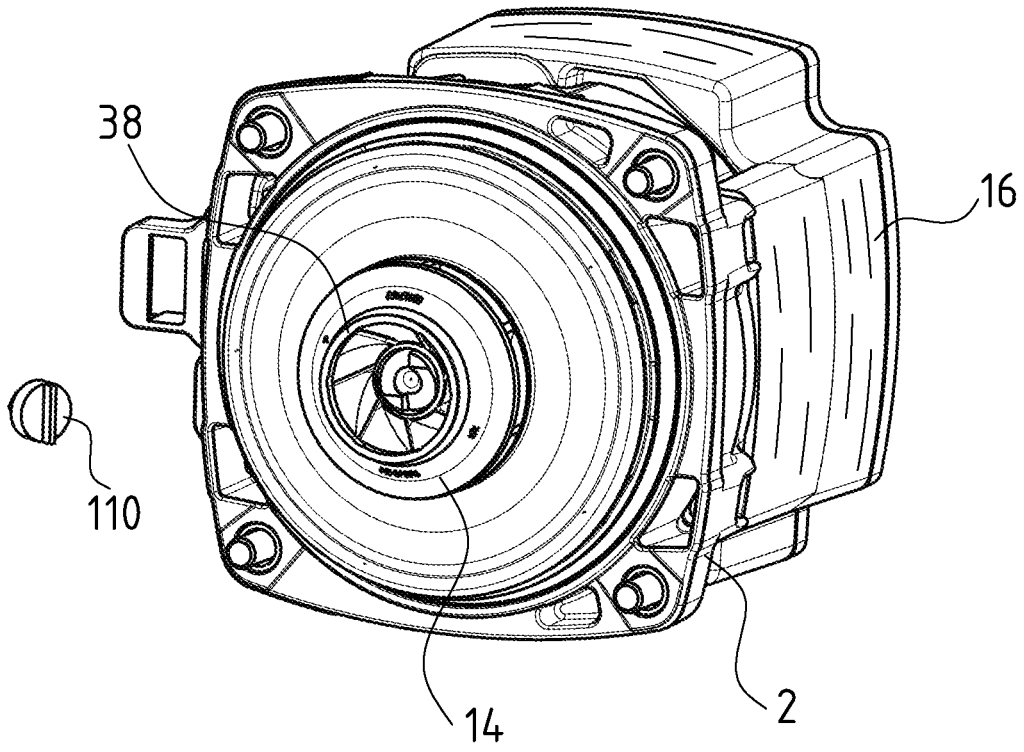
FIG. 30 is a perspective view of the centrifugal pump assembly according to FIG. 29 with a removed pump casing and valve element.
Figure 31:
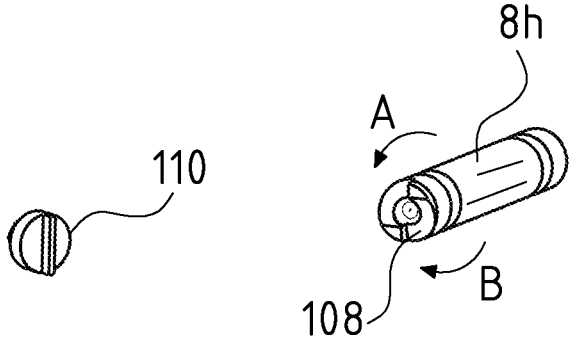
FIG. 31 is a perspective view of the motor shaft of the centrifugal pump assembly according to FIGS. 29 and 30 as well as of the coupling part of the valve element.

In a first switching position which is shown in FIG. 27, the passage 106 can lie opposite inlet 30' and in a second switch position which is shown in FIG. 28 can lie opposite the inlet 28'. The other inlet is closed in each case. For this, the valve element 18*g* can be pressed in the axial direction into bearing contact on the base of the pump casing 2 which surrounds the inlets 28' and 30', by way of the pressure prevailing in the delivery chamber 26, in accordance with the embodiments described above.

The movement of the valve element 18*g* is effected via the drive of the impeller 14. At the start, the rotor shaft 8 bears non-positively on the inner periphery of the ring segments 10 and co-rotates these and thus the valve element 18*g*. Stops for both switching positions can be formed in the pump casing 12 in the manner described above. When the valve element 18*g* reaches one of these stops, then the pump shaft 8 slides through in the inside of the ring segments 100. Moreover, a lubrication film forms between the outer periphery of the rotor shaft 8 and the inner surfaces of the ring segments 100 in the manner of a plain bearing, given an increasing speed of the rotor shaft 8, so that the rotor shaft 8 can then rotate in an essentially frictionless manner in the inside of the ring segments 100. This means that for adjusting or actuating the valve element 18*g* between its two switching positions, the drive motor is moved by the control device 17 preferably at a lower speed than the speed at which the impeller 14 is rotated on operation. The drive motor can be driven in two rotation directions in the manner described above, for moving the valve element 18*g* to and fro, wherein again after reaching the desired switching position, by way of a rapid speed increase, one can succeed in the valve element 18*g* remaining in the previously reached switching position on account of the pressure in the delivery chamber 26 and the bearing contact of the valve element on the base of the pump casing 12, in the manner described above.

With regard to the ninth and tenth embodiment according to FIG. 29 to 37 as well as 38 to 47, a mechanical coupling is likewise provided between the drive motor and the valve element, wherein concerning these embodiments, the drive motor can be activated in two different operational types or modes by way of the control device 17. In a first operation mode which corresponds to the normal operation of the circulation pump assembly, the drive motor rotates in the conventional manner at a desired speed which can be adjusted, in particular by the control device 17. In the second operating mode, the drive motor is activated (controlled) in open loop operation, so that the rotor can be rotated stepwise in individual angular steps which are smaller than 360°. The drive motor can therefore be moved in individual steps in the manner of a stepper motor, which concerning these embodiment examples is used in order to move the valve element in small angular steps into a defined position in a targeted manner, as is described hereinafter.

With regard to the ninth embodiment according to FIG. 29 to 37, a mixing valve as can be used for example for temperature adjustment for a floor heating is integrated in the pump casing 2.

Figure 33:
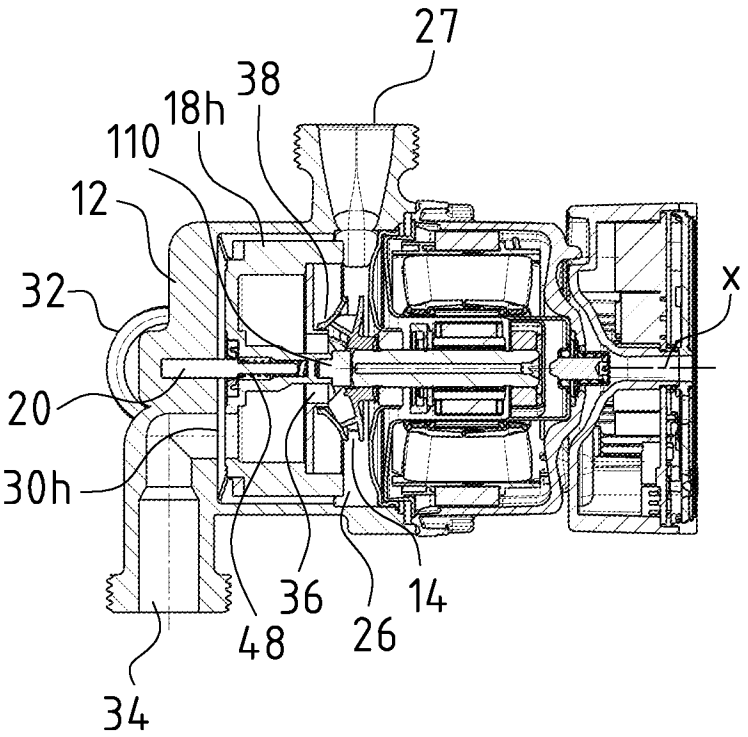
FIG. 33 is a sectional view according to FIG. 32 with the valve element in a second position.
Figure 32:
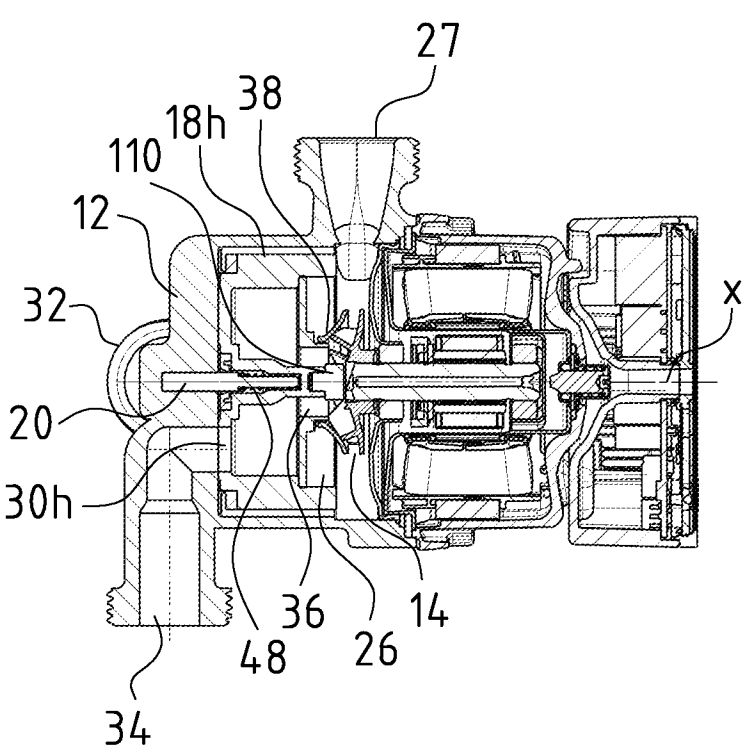
FIG. 32 is a sectional view of the centrifugal pump assembly according to FIG. 29 with the valve element in a first position.

The motor casing 2 with the electronics casing 16 corresponds to the previously described embodiment. The pump casing 12 is constructed in essentially the same manner as the pump casing according to the first embodiment according to FIG. 1 to 6, and it is only the outer configuration which is different. With this ninth embodiment, the valve element 18*h* is likewise configured in a drum-like manner and consists of a pot-like lower part 76*h* which at its side which faces the impeller 14 is closed by a cover 78*h*. A suction opening 36 is formed in the central region of the cover 78*h*. The valve element 18*h* is rotatably mounted on a pivot 20 which is arranged in the base of the pump casing 12. Here, the rotation axis of the valve element 18*h* corresponds to the rotation axis X of the rotor shaft 8*h*, as is the case with the examples described above. Here, the valve element 18*h* is likewise axially displaceable along the axis X and is pressed by a spring 48 into the idle position which is shown in FIG. 33 and in which the valve element 18*h* is located in released position, in which the lower part 76*h* does not bear on the base of the pump casing 12, so that the valve element 18*h* is essentially freely rotatable about the pivot 20. In the released position, the face end of the rotor shaft 8*h* which is configured as a coupling 108 functions as an axial stop. The coupling 108 engages with a counter coupling 110 which is arranged on the valve element 18*h* in a rotationally fixed manner. The coupling 108 comprises inclined (beveled) coupling surfaces which along a peripheral line essentially describe a saw-toothed profile in a manner such that a torque transmission from the coupling 108 onto the counter coupling 110 is only possible in one rotation direction, specifically in the rotation direction A in FIG. 31. In contrast, the coupling slips through in the opposite rotation direction B, wherein an axial movement of the valve element 18*h* occurs. The rotation direction B is that rotation direction, in which the pump assembly is driven in normal operation. In contrast, the rotation direction A is used for the targeted actuation of the valve element 18*h*. This means that a rotation-direction-dependent coupling is formed here. However, concerning this embodiment too, the counter-coupling 110 also disengages from the coupling 108 due to the pressure in the delivery chamber 26. If the pressure in the delivery chamber 26 increases, then a pressing force which is opposed to the spring force of the spring 48 and which exceeds this acts upon the cover 78*h*, so that the valve element 18*h* is pressed into the bearing position as is shown in FIG. 32. In this position, the lower part 76*h* bears on the base side of the pump casing 12, so that on the one hand the valve element 18*h* is non-positively held and on the other hand a sealed bearing contact is achieved, said bearing contact sealing the delivery side and the suction side with respect to one another in the subsequently described manner.

Figure 36:
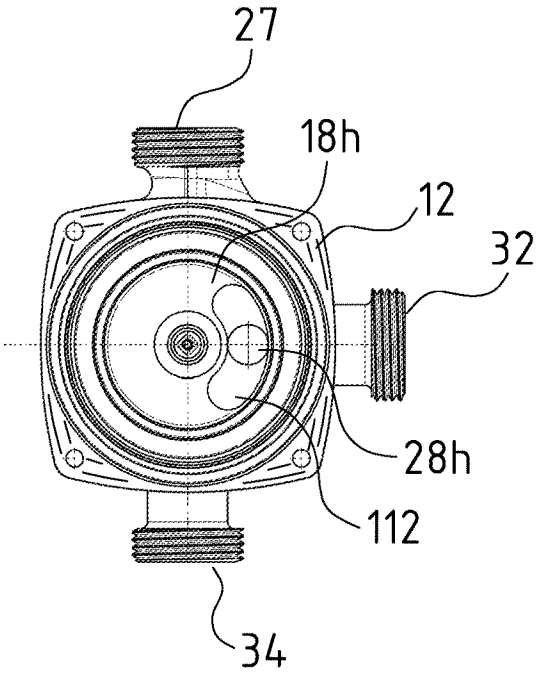
FIG. 36 is a plan view according to FIGS. 34 and 35 with the valve element in a third switching position.
Figure 35:
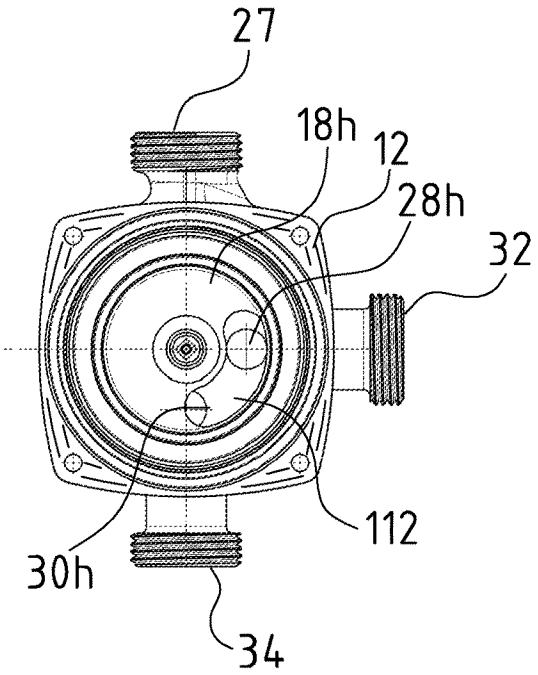
FIG. 35 is a plan view according to FIG. 34 with the valve element in a second switching position.
Figure 34:
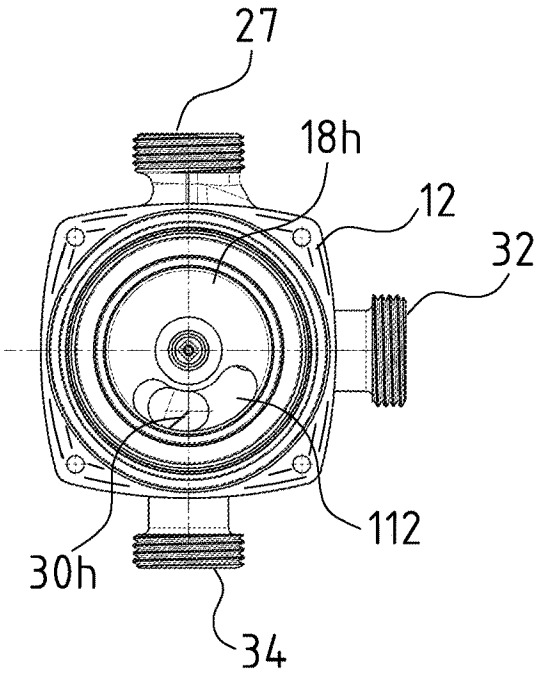
FIG. 34 is a plan view upon the opened pump casing of the centrifugal pump assembly according to FIG. 29 to 33 with the valve element in a first switching position.

The pump casing 12 comprises two suction branches 32 and 34, of which the suction branch 32 runs out at an inlet 28*h* and the suction branch 34 at an inlet 30*h*, in the base of the pump casing 12 into the interior of this, which is to say into the suction chamber 24. The lower part 76*h* of the valve element 18*h* in its base comprises an arched opening 112 which extends essentially over 90°. FIG. 34 shows a first switching position, in which the opening 112 only overlaps the inlet 30*h*, so that a flow path is only given from the suction branch 34 to the suction opening 36 and therefore to the suction port 38 of the impeller 14. The second inlet 28*h* is sealingly closed by the base of the valve element 18*h* which bears in the peripheral region of this second inlet. FIG. 36 shows the second switching position, in which the opening 112 only overlaps the inlet 28*h*, whilst the inlet 30*h* is closed. In this switching position, only a flow path from the suction branch 32 to the suction port 38 is opened. FIG. 35 now shows an intermediate position, in which the opening 112 overlaps both inlets 28*h* and 30*h*, wherein the inlet 30*h* is only partly released. A mixing ratio between the flows from the inlets 28*h* and 30*h* can be changed by way of changing the degree of release of the branch 30*h*. The valve element 18*h* can also be actuated or adjusted in small steps via the stepwise actuation of the rotor shaft 8*h*, in order to change the mixing ratio.

Figure 37:
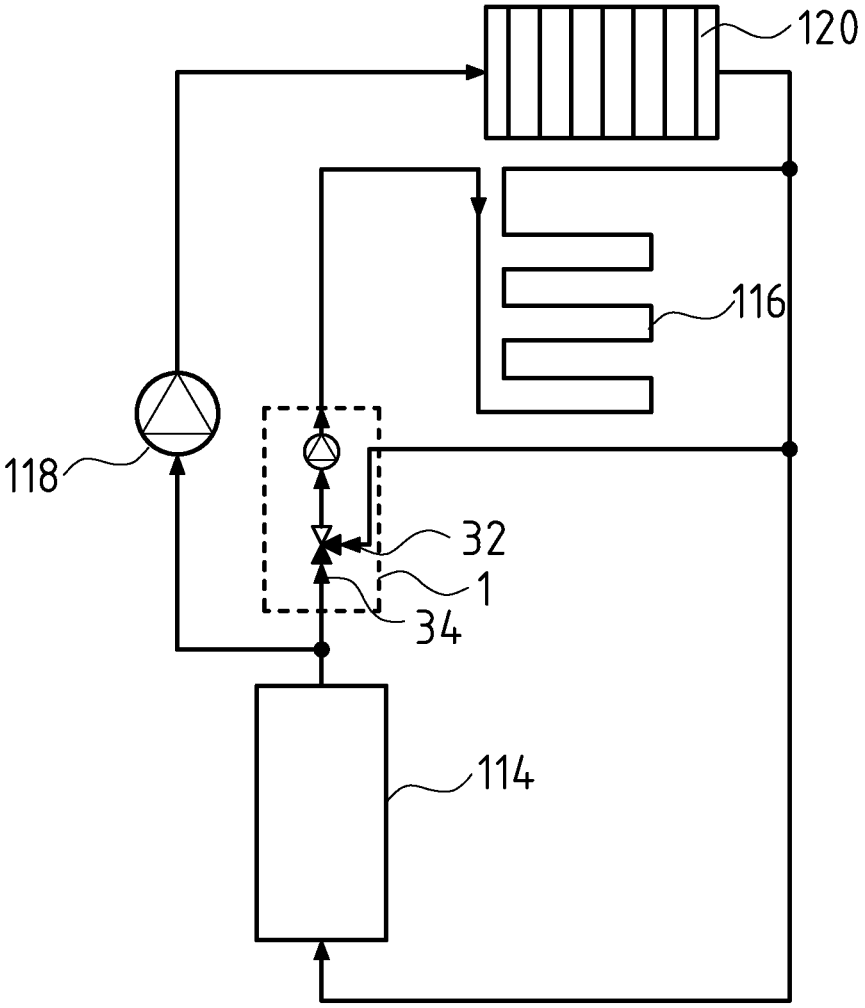
FIG. 37 is a schematic view of the hydraulic construction of a heating facility with a centrifugal pump assembly according to FIG. 29 to 36.
Figure 38:
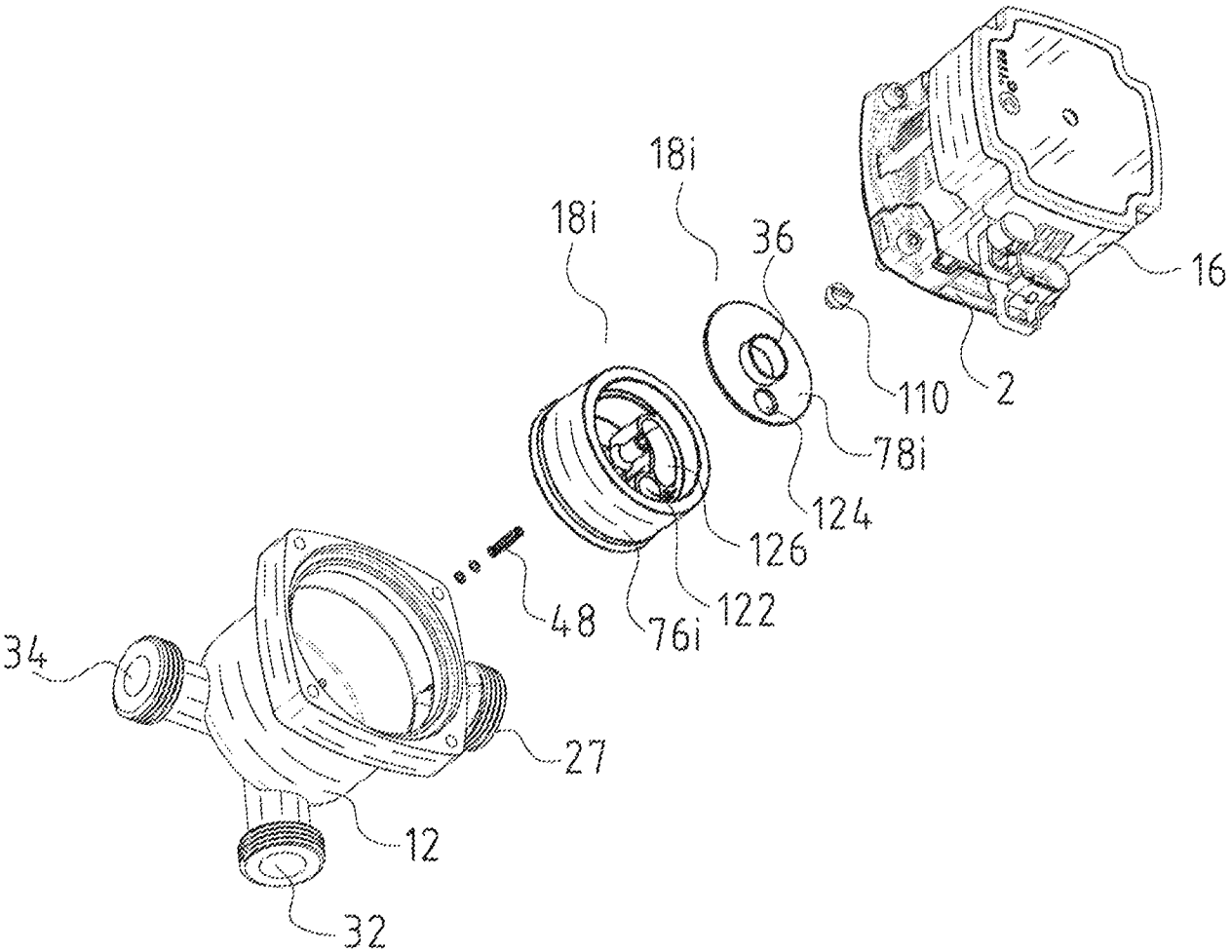
FIG. 38 is an exploded view of a centrifugal pump assembly according to a tenth embodiment of the invention.
Figure 39:
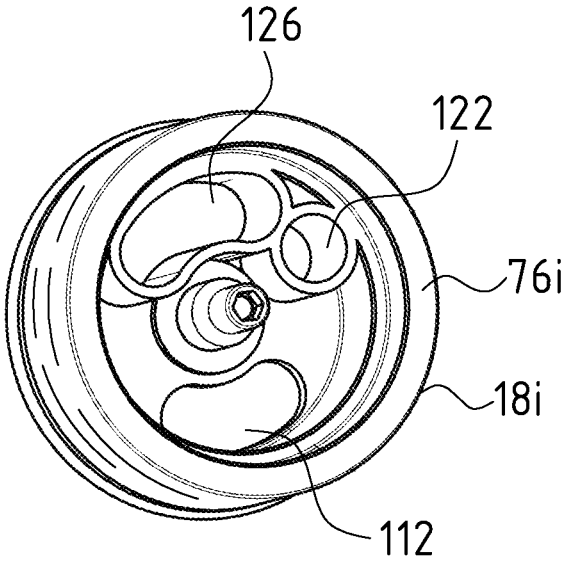
FIG. 39 is a perspective view of the opened valve element of the centrifugal pump assembly according to FIG. 38.
Figure 40:
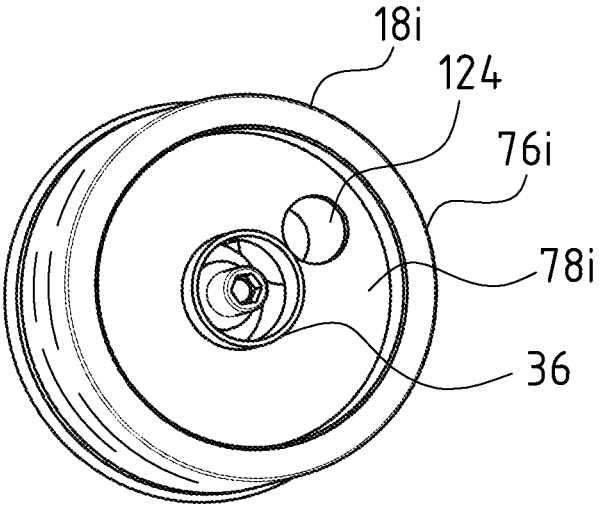
FIG. 40 is a perspective view of the closed valve element according to FIG. 39.
Figure 42:
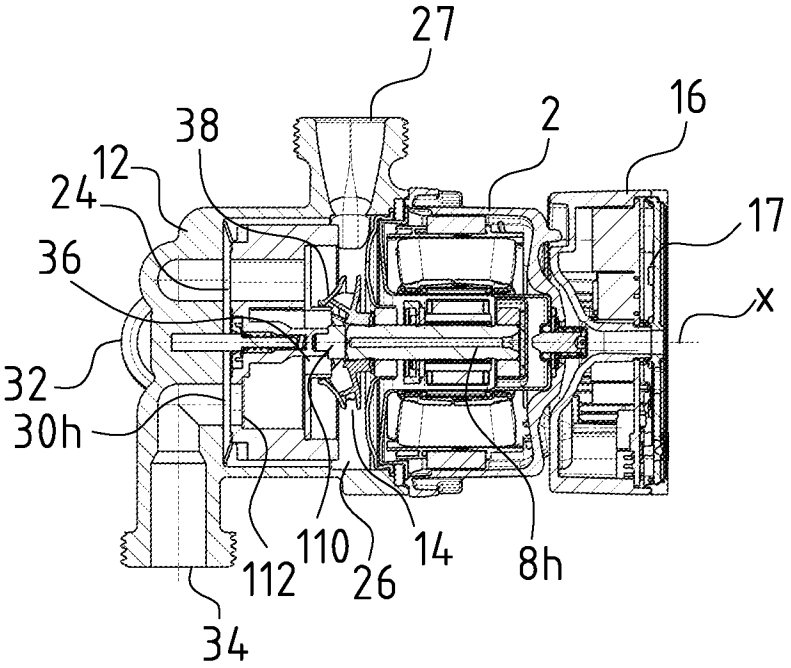
FIG. 42 is a sectional view according to FIG. 41 with the valve element in a second position.
Figure 41:
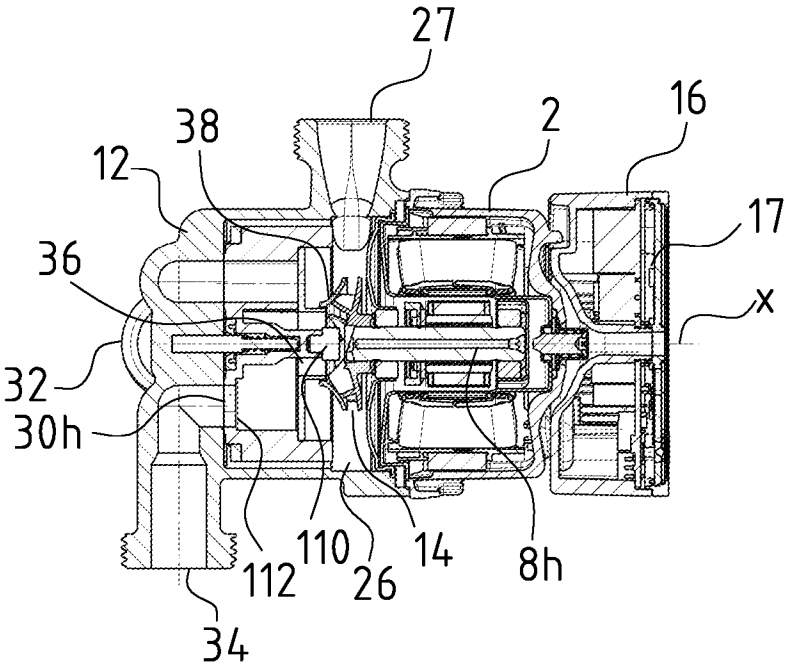
FIG. 41 is a sectional view of the centrifugal pump assembly according to FIG. 38 with the valve element in a first position.

Such a functionality can be applied for example in a hydraulic system as is shown in FIG. 37. There, the centrifugal pump assembly with the integrated valve as has been described above is characterized by the dashed line 1. The hydraulic circuit comprises a heat source 114 in the form of a gas heating boiler for example, the outlet of which running out for example into the suction branch 34 of the pump casing 12. In this example, a floor heating circuit 116 whose return is connected to the inlet of the heat source 114 as well as to the suction branch 32 of the centrifugal pump assembly 114 connects onto the delivery branch 27 of the centrifugal pump assembly 1. A further heating circuit 120 can be supplied with a heat transfer medium which has the outlet-side temperature of the heat source 114, via a second centrifugal pump assembly 118. The floor heating circuit 116 in contrast can be regulated in its feed temperature in a manner such that cold water from the return is admixed to the hot water at the outlet side of the heat source 114, wherein the mixing ratio can be changed by way of changing the opening ratios of the inlets 28*h* and 30*h* in the manner described above by way of rotating the valve element 18*h*.

The tenth embodiment example according to FIG. 38 to 47 shows a centrifugal pump assembly which additionally to the previously described mixing function yet comprises a switch-over functionality for the additional supply of a secondary heat exchanger for the heating of service water.

Concerning this embodiment, the mounting and drive of the valve element 18*i* is effected just as with the ninth embodiment. In contrast to the valve element 18*h*, the valve element 18*i* additionally to the opening 112 comprises a through-channel 122 which extends from an opening 124 in the cover 78*i* to an opening in the base of the lower part 76*i* and therefore connects the two axial ends of the valve element 18*i* to one another. An arched bridging opening 126 is moreover yet formed in the valve element 18*i* and this opening is closed to the delivery chamber 28 by the cover 78*i* and is only open to the lower side, which is to say to the base of the lower part 76*i* and thus to the suction chamber 24.

Figure 44:
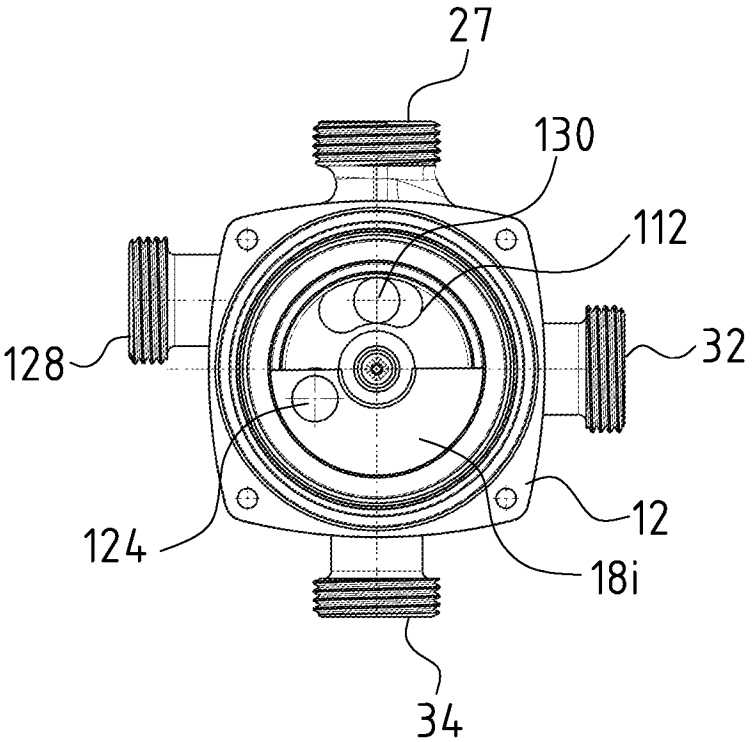
FIG. 44 is a plan view according to FIG. 43 with the valve element in a second switching position.
Figure 43:
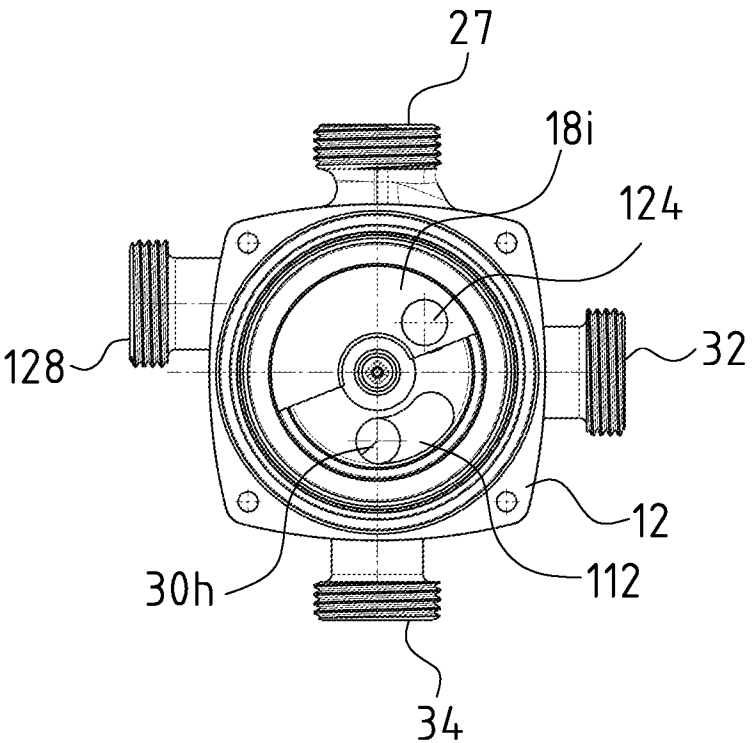
FIG. 43 is a plan view upon the opened pump casing of the centrifugal pump assembly according to FIG. 38 to 42 with the valve element in a first switching position.
Figure 45:
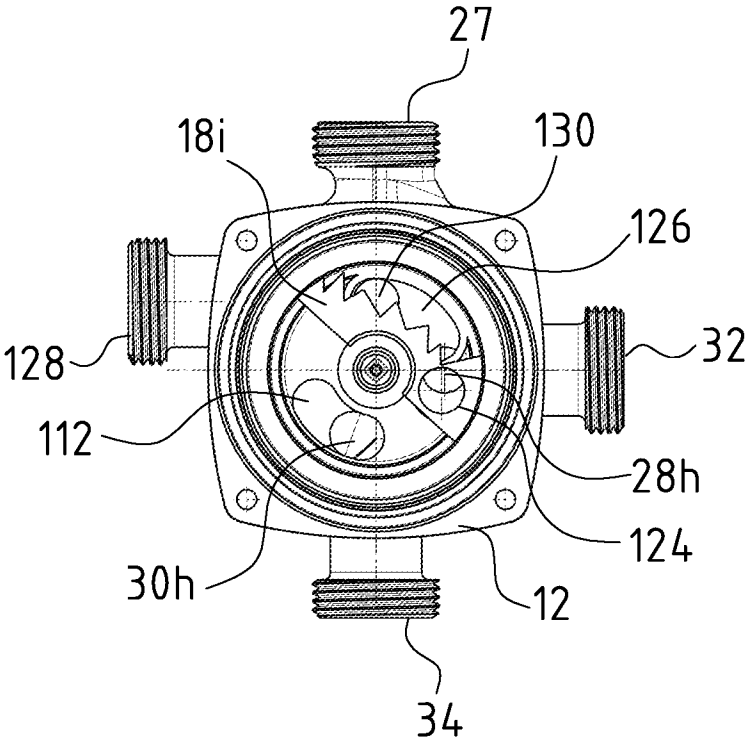
FIG. 45 is a plan view according to FIGS. 43 and 44 with the valve element in a third switching position.

Apart from the delivery branch 27 and both previously described suction branches 34 and 32, the pump casing 12 comprises a further branch 128. The branch 128 runs out in an inlet 130 in the base of the centrifugal pump assembly 12 additionally to the inlets 28*h* and 30*h*, into the suction chamber 24. The various switching positions are explained by way of FIG. 43 to 46, wherein the cover 78*i* of the valve element 18*i* is shown in a partly opened manner in these figures, in order to clarify the position of the openings which lie therebelow. FIG. 43 shows a first switching position, in which the opening 112 lies opposite the inlet 30*h* so that a flow connection from the suction branch 34 to the suction port 38 of the impeller 14 is created. In the switching position according to FIG. 44, the opening 112 lies over the inlet 130, so that a flow connection from the branch 128 to the suction opening 36 and via this into the suction port 38 of the impeller 14 is created. In a further switching position which is shown in FIG. 45, the opening 112 lies over the inlet 30*h*, so that again a flow connection from the suction branch 34 to the suction port 38 of the impeller 14 is given. A partial overlapping of the opening 124 and of the through-hole 122 with the inlet 28*h* simultaneously takes place, so that a connection between the delivery chamber 26 and the suction port 32 which functions here as a delivery branch is created. The bridging opening 126 simultaneously overlaps the inlet 130 and a part of the inlet 28*h*, so that a connection from the branch 128 to the branch 32 is likewise created via the inlet 130, the bridging opening 126 and the inlet 28*h*.

Figure 46:
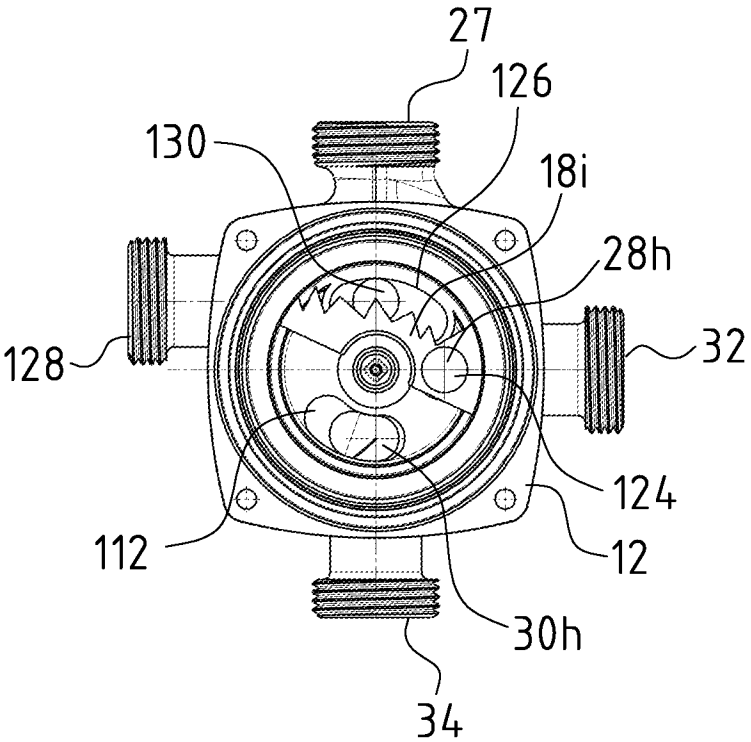
FIG. 46 is a plan view according to FIG. 43 to 45 with the valve element in a fourth switching position.

FIG. 46 shows a fourth switching position, in which the through-channel 122 completely overlaps the inlet 28*h*, so that the branch 32 is connected to the delivery chamber 26 via the through-channel 122 and the opening 124. Simultaneously, the bridging opening 126 continues to cover only the inlet 130. The opening 112 continues to cover the inlet 30*h*.

Figure 47:
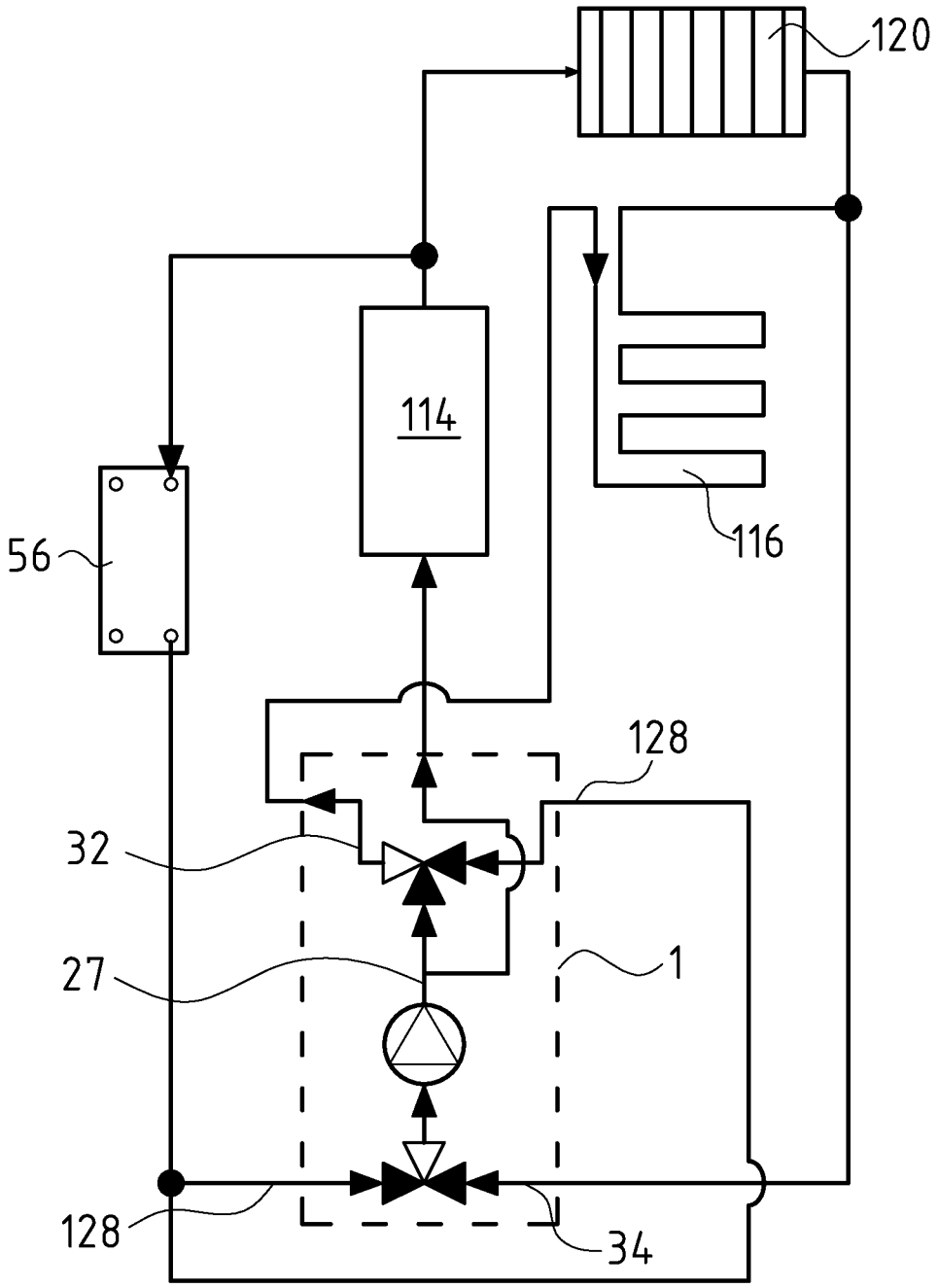
FIG. 47 is a schematic view of the hydraulic construction of a heating facility with a centrifugal pump assembly according to FIG. 38 to 46.

Such a centrifugal pump assembly can be applied for example in a heating system as is shown in FIG. 47. Here, the dashed line delimits the centrifugal pump assembly 1, as has just been described by way of FIG. 38 to 46. The heating system again comprises a primary heat exchanger or a heat source 114 which for example can be gas heating boiler. At the outlet side, the flow path runs into a first heating circuit 120 which can be formed for example by way of conventional radiators. A flow path simultaneously branches to a secondary heat exchanger 56 for heating service water. The heating system moreover comprises a floor heating circuit 116. The returns of the heating circuit 120 and of the floor heating circuit 116 run out into the suction branch 34 on the pump casing 12. The return from the secondary heat exchanger 56 runs out into the branch 128 which provides two functionalities as is described hereinafter. The branch 32 of the pump casing 12 is connected to the feed of the floor heating circuit 116.

When the valve element 18*i* is located in the first switching position represented in FIG. 43, the impeller 14 delivers fluid from the suction branch 34 via the delivery branch 27 through the heat source 140 and the heating circuit 120 and back to the suction branch 34. If the valve element 18*i* is located in the second switching position which is shown in FIG. 44, the facility is switched over to service water operation and in this condition the pump assembly or the impeller 14 delivers fluid from the branch 128 which serves as a suction branch, through the delivery branch 27, via the heat source 114 through the secondary heat exchanger 56 and back to the branch 128. The floor heating circuit 116 is additionally supplied if the valve element 18*i* is located in the third switching position which is shown in FIG. 45. The water flows into the suction port 38 of the impeller 14 via the suction branch 34 and is delivered via the delivery branch 27 through the first heating circuit 120 via the heat source 114 in the described manner. The fluid at the outlet side of the impeller 14 simultaneously exits the delivery chamber 26 into the opening 124 and through the through-channel 122 and thus flows to the branch 32 and via this into the floor heating circuit 116.

Fluid simultaneously flows via the bridging opening 126 into the branch 32 via the branch 128 and the inlet 130, in the switching position which is shown in FIG. 45. This means that here water flows via the heat source 114 through the secondary heat exchanger 26 and the branch 128 to the branch 32. Since essentially no heat is taken at the secondary heat exchanger 56 in this heating operation, hot water is admixed to the branch 32 additionally to the cold water which flows out of the delivery chamber 26 to the branch 32 via the through-channel 130. The quantity of the admixed warm water at the branch 32 can be varied by way of changing the degree of opening via the valve position 18*i*. FIG. 46 shows a switching position, in which the admixing is switched off and the branch 32 is exclusively in direct connection with the delivery chamber 26. In this condition, the water in the floor heating circuit 116 is delivered in the circuit without any supply of heat. It is to be recognized that with this embodiment, a switching between the heating and service water heating as well as simultaneously the supply of heating circuits with two different temperatures, specifically of a first heating circuit 120 with the exit temperature of the heat source 114 and of a floor heating circuit 116 with a temperature which is reduced via a mixing function, can also be achieved by way of the change of the switching positions of the valve element 18*i*.

It is to be understood that the various previously described embodiments can be combined with one another in a different manner. Thus the different described drive modes of the valve element can be essentially arbitrarily combined with different geometric designs of the valve element as have likewise been described above. The different valve functionalities (for example mixing and switching-over) can likewise be realized and combined with different drive modes. These different combination possibilities which are to be derived from the preceding embodiment examples are expressly encompassed by the invention.

While specific embodiments of the invention have been shown and described in detail to illustrate the application of the principles of the invention, it will be understood that the invention may be embodied otherwise without departing from such principles.

The invention claimed is:

1. A centrifugal pump assembly comprising:

an electrical drive motor an impeller which is driven by the electrical drive motor;

a pump casing which surrounds the impeller and which comprises at least two branches;

a movable valve element arranged in the pump casing, said valve element being movable between at least two switching positions, in which the flow paths through the at least two branches are opened to a different extent, wherein the valve element is configured and arranged in the pump casing such that the valve element separates a suction chamber, which is connected to a suction side of the impeller, from a delivery chamber, which is in connection with the delivery side of the impeller, the valve element being rotatable between the at least two switching positions about a rotation axis aligned to a rotation axis of the impeller;

a coupling configured to mechanically and/or hydraulically couple the valve element to the drive motor for at least a movement between the at least two switching positions, the coupling being completely inside the pump casing.

2. A centrifugal pump assembly according to claim 1, wherein the valve element is rotatably mounted with respect to a valve element center and is rotatably mounted in the pump casing independently of the impeller.

3. A centrifugal pump assembly according to claim 1, wherein the valve element is rotatably mounted in the inside of the pump casing, in a space which is filled with a fluid to be delivered.

4. A centrifugal pump assembly according to claim 1, wherein the valve element is configured and arranged such that the valve element is movable along a first movement path between the least two switching positions and additionally along a second movement path which runs angled to the first movement path, wherein the valve element is movable along the second movement path between a first position, in which the valve element is distanced to at least one contact surface, and a second position, in which the valve element is in bearing contact with the at least one contact surface.

5. A centrifugal pump assembly according to claim 4, wherein the second movement path is aligned with the rotation axis of the impeller.

6. A centrifugal pump unit according to claim 4, wherein an end position of the movement of the valve element along the second path of movement is defined by a stop at an axial end of a rotor shaft of the driving motor.

7. A centrifugal pump assembly according to claim 4, wherein the valve element is subjected to a restoring force by way of a restoring element, said restoring force acting along the second movement path and acting in the direction of the first position.

8. A centrifugal pump assembly according to claim 4, wherein the valve element comprises a pressure surface which faces the delivery chamber and upon which the pressure prevailing in the delivery chamber acts such that the valve element along the second movement path is subjected to a pressing force which acts in the direction of the second position.

9. A centrifugal pump assembly according to claim 4, wherein the at least one contact surface is a sealing surface.

10. A centrifugal pump assembly according to claim 9, wherein the at least one sealing surface is situated such that the delivery chamber is sealed with respect to the suction chamber by way of the valve element bearing on the sealing surface.

11. A centrifugal pump assembly according to claim 9, wherein the at least one sealing surface is situated such that one of the branches is sealed with respect to the suction chamber by way of the valve element bearing on the sealing surface.

12. A centrifugal pump assembly according to claim 4, wherein the at least one contact surface extends angled to the second movement path.

13. A centrifugal pump assembly according to claim 1, wherein the valve element is configured such that the valve element is movable, by way of a fluid flow in the delivery chamber, in a rotation direction of the impeller and/or the valve element is coupled to the impeller or to a shaft which drives the impeller for movement, via a coupling which is pressure-dependent and/or speed-dependent and/or rotation-direction-dependent releasable.

14. A centrifugal pump assembly according to claim 1, wherein the configuration and arrangement of at least one valve element is such that a flow which is produced by the impeller, in the delivery chamber, acts upon the valve element for valve element movement between the at least two switching positions.

15. A centrifugal pump assembly according to claim 1, wherein the valve element comprises an opening, via which the suction chamber is in connection with a suction port of the impeller, wherein the suction port of the impeller is in bearing contact or engagement with the valve element in a peripheral region of the opening.

16. A centrifugal pump assembly according to claim 1, wherein the drive motor comprises a control device, via which the drive motor is activated such that the drive motor can be driven in two rotation directions.

17. A centrifugal pump assembly according to claim 1, wherein the drive motor comprises a control device, via which the drive motor is adjustable in motor speed and in is started up with different acceleration courses.

18. A centrifugal pump assembly comprising:

a pump casing having two branches;

an impeller rotatably arranged in said pump casing about an axis;

a drive motor configured to rotate said impeller about said axis;

a valve element rotatably arranged in the pump casing, said valve element being rotatable between two switching positions about said axis, movement of said valve element between said two switching positions variably opening said two branches;

a mechanical and/or hydraulic coupling physically arranged between said valve element and said impeller in a direction of said axis, said coupling being configured to move said valve element between said two switching positions.

19. A centrifugal pump assembly in accordance with claim 18, wherein:

said coupling is entirely arranged between said valve element and said impeller in said direction of said axis.

20. A centrifugal pump assembly in accordance with claim 18, wherein:

said impeller has a suction side and a delivery side;

said pump casing defines a suction chamber being in communication with said suction side of the impeller;

said pump casing defines a delivery chamber being in communication with said delivery side of the impeller;

said valve element being arranged to separate said suction chamber and said delivery chamber.

* * * * *